US008707854B2

(12) United States Patent
Meguro et al.

(10) Patent No.: US 8,707,854 B2
(45) Date of Patent: Apr. 29, 2014

(54) HYDRAULIC CYLINDER DEVICE AND BOAT PROPELLING APPARATUS INCLUDING THE SAME

(75) Inventors: Katsuji Meguro, Shizuoka (JP); Hideki Saito, Shizuoka (JP)

(73) Assignee: Yamaha Motor Hydraulic System Kabushiki Kaisha, Shizuoka (JP)

( * ) Notice: Subject to any disclaimer, the term of this patent is extended or adjusted under 35 U.S.C. 154(b) by 1175 days.

(21) Appl. No.: 12/633,855

(22) Filed: Dec. 9, 2009

(65) Prior Publication Data

US 2010/0285706 A1 Nov. 11, 2010

(30) Foreign Application Priority Data

May 8, 2009 (JP) ..... 2009-113141

(51) Int. Cl.
*F01B 31/00* (2006.01)
*F01B 9/00* (2006.01)

(52) U.S. Cl.
USPC ..... 92/167

(58) Field of Classification Search
USPC ..... 92/167, 172
See application file for complete search history.

(56) References Cited

U.S. PATENT DOCUMENTS

| | | | | | |
|---|---|---|---|---|---|
| 500,720 | A | * | 7/1893 | Rebsamen | 92/172 |
| 5,058,487 | A | * | 10/1991 | Faitel | 92/167 |
| 5,529,519 | A | | 6/1996 | Nakamura et al. | |
| 6,062,923 | A | | 5/2000 | Kai | |
| 6,309,264 | B1 | | 10/2001 | Saito | |

FOREIGN PATENT DOCUMENTS

| | | | |
|---|---|---|---|
| JP | 61-132199 | U | 8/1986 |
| JP | 05-037692 | U | 5/1993 |
| JP | 07-081678 | A | 3/1995 |
| JP | 11-105790 | A | 4/1999 |
| JP | 2000-018212 | A | 1/2000 |
| JP | 2000-072088 | A | 3/2000 |
| JP | 2003-072570 | A | 3/2003 |

* cited by examiner

*Primary Examiner* — F. Daniel Lopez
(74) *Attorney, Agent, or Firm* — Keating & Bennett, LLP

(57) ABSTRACT

A trim device includes a trim cylinder, a piston, a piston rod and a support member. The piston is slidable inside the trim cylinder, in the axial direction of the trim cylinder. The piston rod is connected with the piston and moves in the axial direction of the trim cylinder following the movement of the piston. The support member is slidable relative to the piston rod and arranged to support the piston rod so that the piston rod's axial center can become tilted with respect to the axial center of the cylinder.

6 Claims, 22 Drawing Sheets

HYDRAULIC CYLINDER DEVICE AND BOAT PROPELLING APPARATUS INCLUDING THE SAME

BACKGROUND OF THE INVENTION

1. Field of the Invention

The present invention relates to hydraulic cylinder devices and boat propelling apparatuses. More specifically, the present invention relates to a hydraulic cylinder device for use in adjusting a slant angle of the propelling apparatus main body, and a boat propelling apparatus including the hydraulic cylinder device.

2. Description of the Related Art

In boats equipped with a boat propelling apparatus, a slant angle of the propelling apparatus main body with respect to the boat body is adjusted in accordance with the mode of travel. Specifically, during a high speed travel mainly, the adjustment in the slant angle of the propelling apparatus main body is performed within a trim range, which is a range of small slant angles, for keeping an appropriate cruising attitude. During a slow speed travel or when the boat is stopping, the adjustment in the slant angle of the propelling apparatus main body is performed within a tilt range, which is a range of large slant angles, in order to prevent the propelling apparatus main body from hitting an underwater object. Such an adjustment of the slant angle of the propelling apparatus main body is performed, generally, by means of a power tilt and trim system.

For example, JP-A Hei 7-81678 discloses a hydraulic power tilt and trim system, in which a trim cylinder is slidably provided inside a tilt cylinder, and a piston rod is provided inside the trim cylinder. The piston rod has a tip connected with a swivel arm which is provided pivotably on the boat body, and a propelling apparatus main body is mounted on this swivel arm.

When adjusting the slant angle of the propelling apparatus main body in the trim range in this hydraulic power tilt and trim system, a hydraulic pressure in the tilt cylinder is adjusted in order to adjust the trim cylinder's position in the tilt cylinder. In this process, the piston rod moves (rises or lowers) inside the tilt cylinder together with the trim cylinder, and the swivel arm pivots with the piston rod as the rod rises or lowers. In this way, the adjustment is made of the slant angle of the propelling apparatus main body in the trim range. When adjusting the slant angle of the propelling apparatus main body in the tilt range, the trim cylinder is moved to its upper end of stroke in the tilt cylinder, and in this state, a hydraulic pressure inside the trim cylinder is adjusted. This adjusts the piston rod's position in the trim cylinder. In this process, the swivel arm pivots with the piston rod as the piston rod rises or lowers, adjusting the slant angle of the propelling apparatus main body in the tilt range.

In the hydraulic power tilt and trim system disclosed in JP-A Hei 7-81678, the piston rod moves linearly in an axial direction of the tilt cylinder and trim cylinder. On the other hand, the swivel arm is arranged to pivot with respect to the boat body. Because of this arrangement, there is a rubbing action where the piston rod's tip portion makes contact with the swivel arm. Specifically, the swivel arm rubs against the piston rod along a direction in which the piston rod travels. The rubbing action causes a sharp increase of a frictional force at a place of contact between the piston rod tip portion and the swivel arm, giving rise to a stick-slip phenomenon and an accompanying noise from the place of contact between the piston rod tip portion and the swivel arm.

SUMMARY OF THE INVENTION

In view of the above, preferred embodiments of the present invention provide a hydraulic cylinder device and a boat propelling apparatus capable of reducing the stick-slip phenomenon.

According to a preferred embodiment of the present invention, a hydraulic cylinder device includes a cylinder, a piston provided inside the cylinder and arranged to be slidable in an axial direction of the cylinder, a piston rod connected with the piston, and a support member arranged to be slidable relative to the piston rod to support the piston rod so that an axial center of the piston rod can be tilted with respect to an axial center of the cylinder.

In a preferred embodiment of the present invention, the support member arranged to support the piston rod allows the piston rod to tilt so that its axial center is tilted with respect to the cylinder's axial center. Therefore, when the piston rod is subjected to an external radial force, the center axis of the piston rod is tilted with respect to the center axis of the cylinder. Thus, when the piston rod's tip portion makes contact with another member and generates a frictional force, the center axis of the piston rod tilts with respect to the center axis of the cylinder in a direction in which an increase in the frictional force is reduced. In this case, since the arrangement prevents the frictional force from increasing rapidly at the place of contact between the piston rod and the other member, it is possible to prevent the stick-slip phenomenon. Also, since the support member allows the piston rod to tilt, it is possible to absorb impact energy and vibration of the piston rod, and thereby to prevent a large impact force from reaching other constituent members of the hydraulic cylinder device.

Preferably, the support member urges the piston rod for substantial axial alignment of the piston rod with the cylinder. In this case, the arrangement provides automatic adjustment so that the piston rod will take an appropriate position. Therefore, it is possible to make more appropriate contact of the piston rod's tip portion with the other member.

Preferably, the support member includes an elastic member. In this case, it is possible to sufficiently absorb the impact energy and vibration from the piston.

More preferably, the support member includes an inner circumferential metal which is fixed inside the elastic member and is slidable to the piston rod, and an outer circumferential metal which is provided on an outer circumferential side of the elastic member. Further, the inner circumferential metal, the elastic member and the outer circumferential metal are in substantial axial alignment with each other. In this case, even if the axial center of the inner circumferential metal is moved off of the axial center of the outer circumferential metal, the elastic member urges the inner circumferential metal so that the inner circumferential metal will become aligned with the outer circumferential metal. This provides automatic position adjustment of the piston rod.

More preferably, hydraulic cylinder device further includes an inner stopper which is provided in the inner circumferential metal so as to be movable in an axial direction of the inner circumferential metal, a first stopper portion which is provided in the inner circumferential metal and is arranged to stop the inner stopper, and a second stopper portion which is immovable in an axial direction of the cylinder and is arranged to stop the inner stopper. In this case, the inner stopper moves together with the inner circumferential metal under a capture by the first stopper portion, but then stops its movement in the axial direction of the cylinder when it is captured by the second stopper portion, whereby the movement of the inner circumferential metal in the axial direction of the cylinder stops also. As a result, excessive deformation of the elastic member is prevented. Therefore, the arrangement reduces deterioration of the elastic member.

Preferably, the support member seals the cylinder. In this case, there is no need for a sealing member to be provided separately, so it becomes possible to simplify the structure of the hydraulic cylinder device.

Preferably, the hydraulic cylinder device further includes a sealing member for sealing the cylinder. In this case, there is no need for the support member to seal the cylinder, so it becomes possible to simplify the structure of the support member.

Preferably, hydraulic cylinder device further includes a limiting portion which has a first curved surface. With this arrangement, the piston has a second curved surface arranged to mate with the first curved surface, and a mating contact made by the first curved surface and the second curved surface limits a movement of the piston in an axial direction of the cylinder, and the second curved surface can slip on the first curved surface for pivotal movement of the piston. In this case, the piston is still capable of pivoting even under a situation where the piston's movement in the axial direction of the cylinder is limited, i.e., even when the piston rod is extended to its limit. Therefore, the axial center of the piston rod can still tilt with respect to the axial center of the cylinder rod even when the piston rod is extended to its limit. Thus, the arrangement sufficiently reduces the stick-slip phenomenon. Also, since the contact between the first curved surface and the second curved surface provide stable support to the piston, it is possible to keep the piston rod as tilted even if the piston rod has been extended to its limit while it is tilted with respect to the cylinder.

Preferably, the piston has a first engagement surface which faces the limiting portion, and the limiting portion which has a second engagement surface arranged to stop the first engagement surface to limit the piston in its axial center slant angle with respect to the axial center of the cylinder. In this case, as the first engagement surface is captured by the second engagement surface, the piston stops pivotal movement, and therefore it is possible to prevent the piston rod's slant angle from becoming excessively large. Thus, it becomes possible to make more appropriate contact of the piston rod's tip portion with the other member.

According to another preferred embodiment of the present invention, a boat propelling apparatus includes a swivel bracket that is pivotable in an up-down direction with respect to a boat body, a propelling apparatus main body mounted on the swivel bracket, and the above-described hydraulic cylinder device arranged to allow the swivel bracket to pivot in the up-down direction for a slant angle adjustment of the propelling apparatus main body with respect to the boat body.

In a preferred embodiment of the present invention, the slant angle of the propelling apparatus main body with respect to the boat body is adjusted with the above-described hydraulic cylinder device, and therefore, it is possible to prevent the stick-slip phenomenon when adjusting the slant angle of the propelling apparatus main body. It is also possible to absorb impact energy and vibration of the piston rod with the support member.

The above-described and other elements, steps, features, characteristics, aspects and advantages of the present invention will become clearer from the following detailed description of preferred embodiments of the present invention with reference to the drawings.

DETAILED DESCRIPTION OF THE PREFERRED EMBODIMENTS

Hereinafter, preferred embodiments of the present invention will be described with reference to the drawings.

Figure 1:
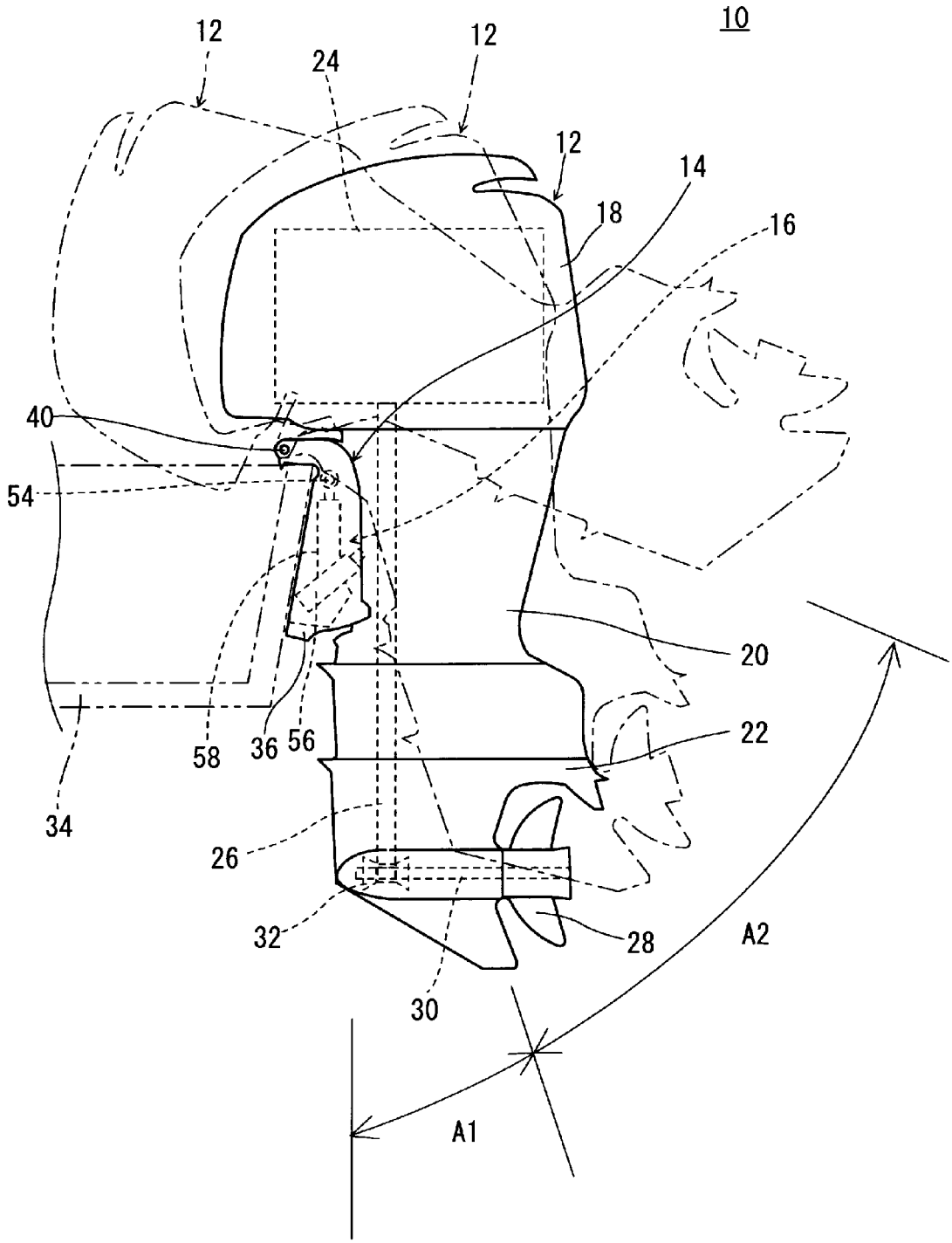
FIG. 1 is a conceptual side view showing a configuration of a boat propelling apparatus according to a preferred embodiment of the present invention.

FIG. 1 is a conceptual side view showing a configuration of a boat propelling apparatus according to a preferred embodiment of the present invention. In the following paragraphs, description will be made for preferred embodiments where a hydraulic cylinder device according to the present invention is applied to a trim device and to a boat propelling apparatus. In a preferred embodiment of the present invention, an up-down direction is determined from a state where a boat body 34 (see FIG. 1) is floating in the water. In FIG. 1, a trim range is indicated by Arrow A1 and a tilt range is indicated by Arrow A2.

As shown in FIG. 1, a boat propelling apparatus 10 includes a propelling apparatus main body 12, a bracket unit 14 and a power tilt and trim system 16. It should be noted here that in order to make the description simple and concise, the power tilt and trim system 16 is shown in a simplified line drawing in FIG. 1 as well as in FIG. 2 which will be referred to later.

The propelling apparatus main body 12 has a top cowling 18, an upper case 20 and a bottom case 22. An engine 24 is mounted inside the top cowling 18. Inside the upper case 20 and the bottom case 22, a drive shaft 26 extends in the up-down direction. The drive shaft 26 has an upper end portion connected with a crankshaft (not illustrated) of the engine 24. A propeller 28 is provided on a rear side of the bottom case 22. The propeller 28 is connected with an end of a propeller shaft 30. The propeller shaft 30 has another end portion connected with a lower end portion of the drive shaft 26 via a bevel gear 32. With such a configuration as the above, a driving force from the engine 24 is transmitted through the drive shaft 26, the bevel gear 32 and the propeller shaft 30, to the propeller 28, enabling the propeller 28 to make normal or reverse rotation thereby generating a propelling force which causes the boat body 34 to make a forward or a backward travel.

Figure 2:
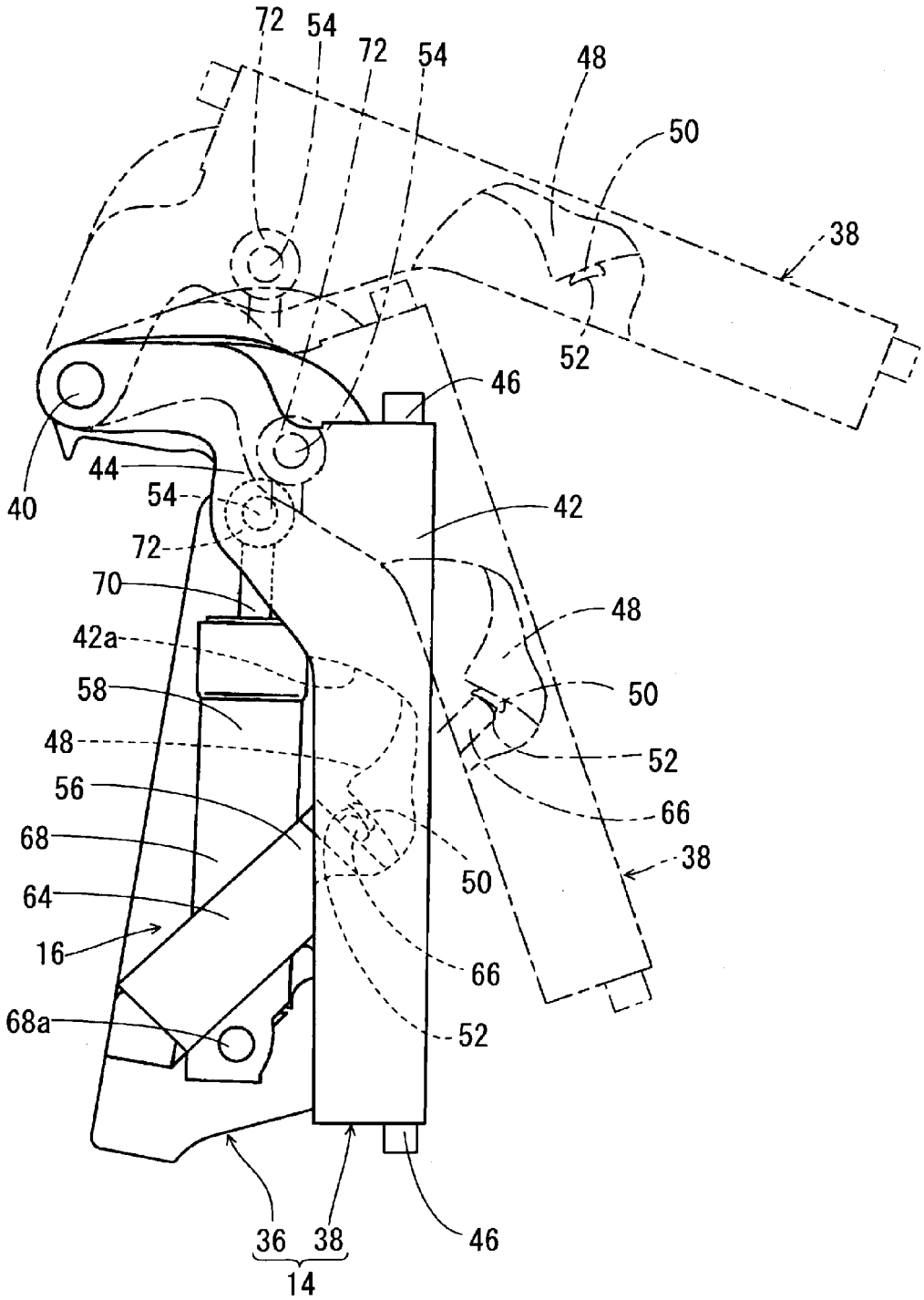
FIG. 2 is a side view for describing a relationship between a bracket unit to a power tilt and trim system.
Figure 3:
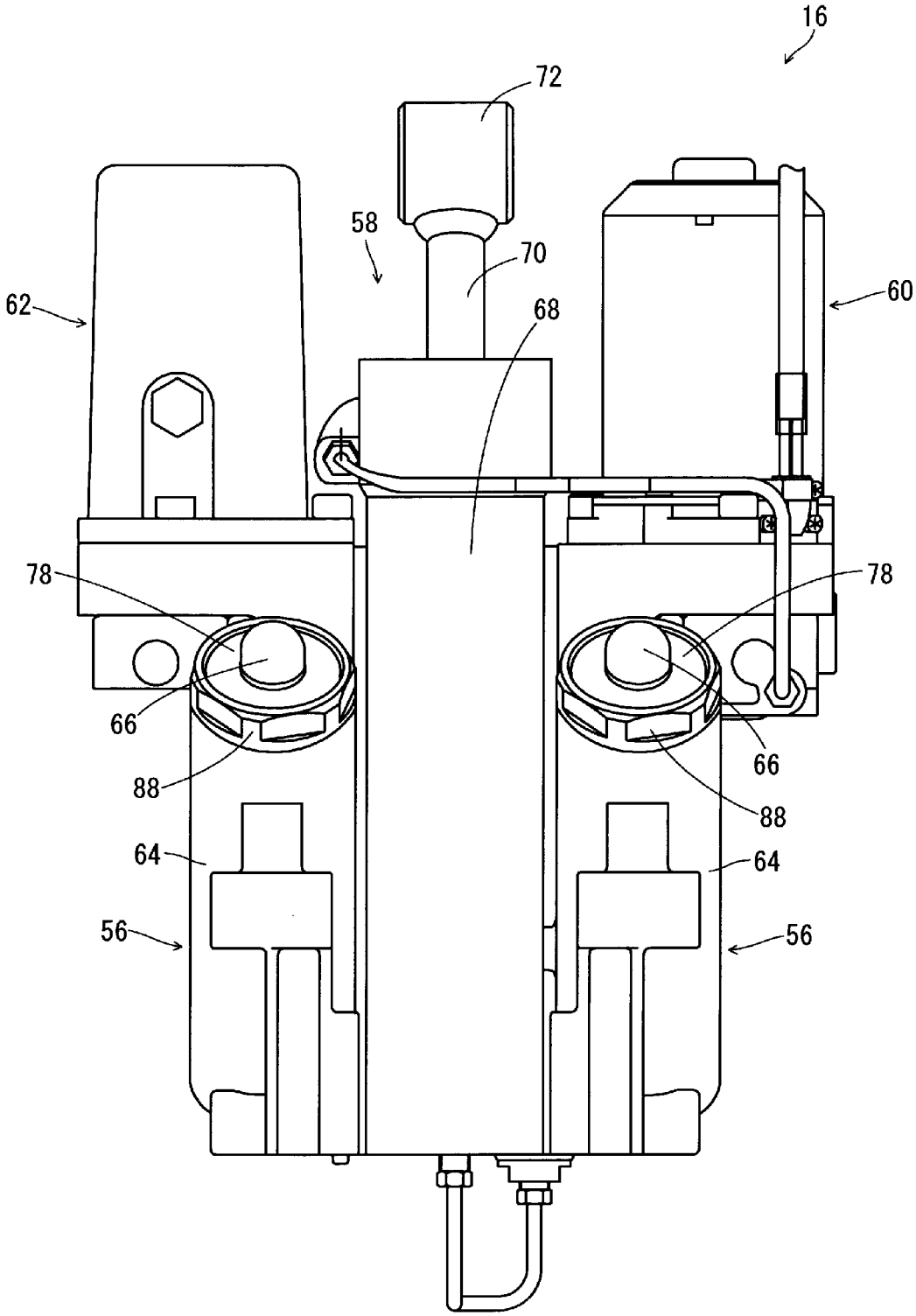
FIG. 3 is a front view (as viewed from behind a propelling apparatus main body) of the power tilt and trim system.
Figure 4:
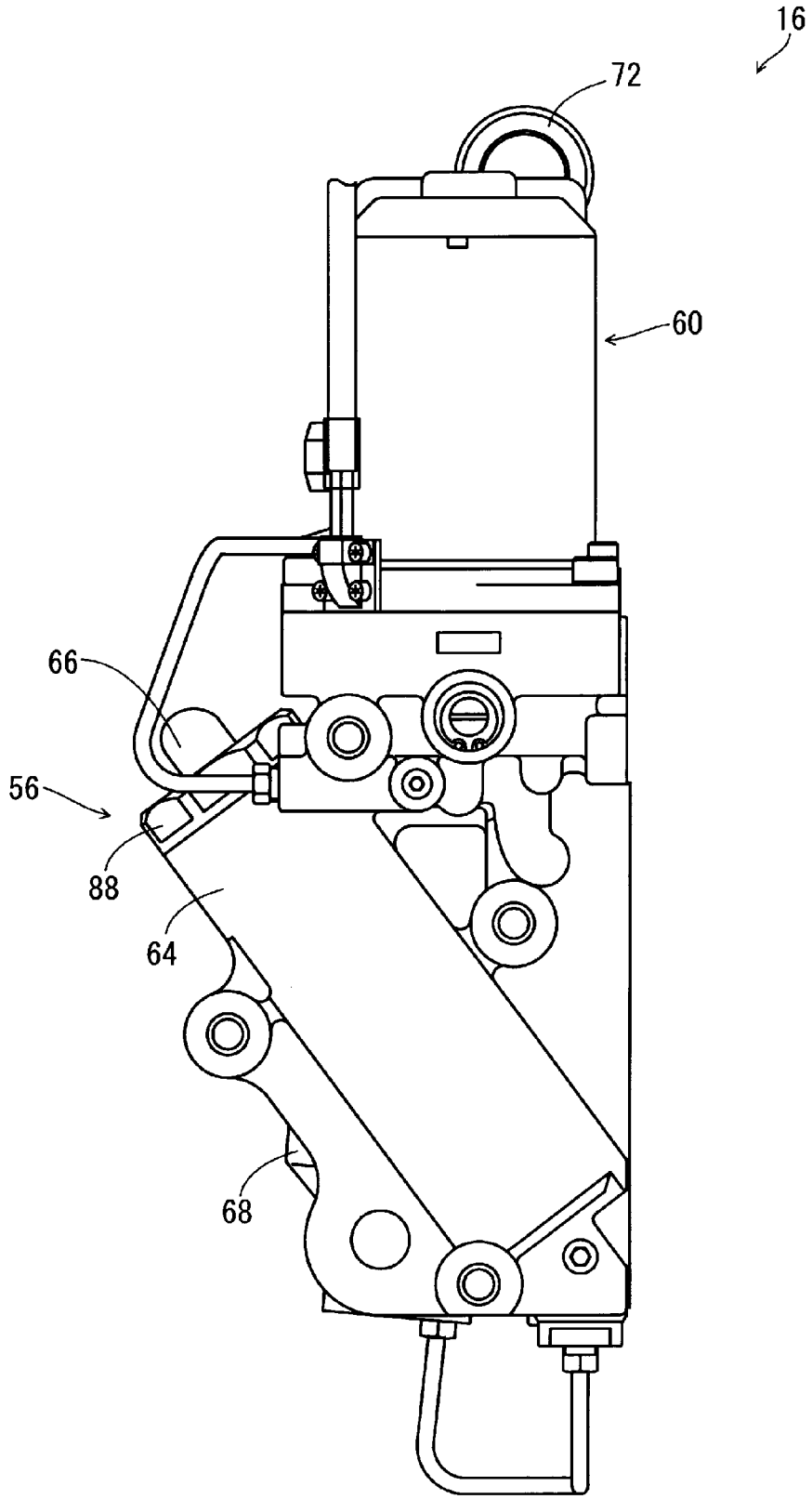
FIG. 4 is a side view of the power tilt and trim system.
Figure 5:
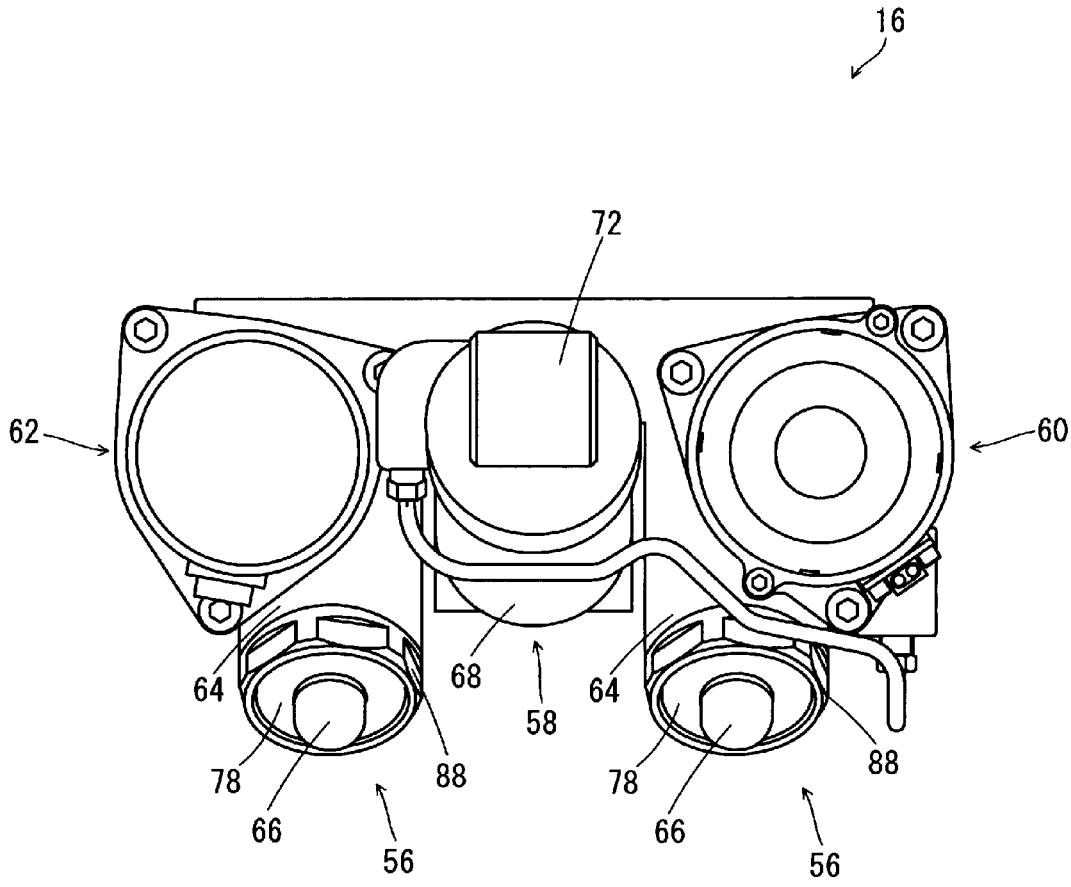
FIG. 5 is a plan view of the power tilt and trim system.

FIG. 2 is a side view for describing a relationship between the bracket unit 14 and the power tilt and trim system 16 in FIG. 1. FIG. 3 is a front view (as viewed from behind the propelling apparatus main body 12) of the power tilt and trim system 16 in FIG. 1. FIG. 4 is a right side view of the power tilt and trim system 16 in FIG. 3. FIG. 5 is a plan view of the power tilt and trim system 16 in FIG. 3.

Referring to FIG. 1 and FIG. 2, the bracket unit 14 includes a pair of clamp brackets 36 fixed to a rear portion of the boat body 34, spaced from each other in a horizontal direction (the widthwise direction of the boat body 34); and a swivel bracket 38 (see FIG. 2) mounted between the clamp brackets 36. It should be noted here that in order to make the description simpler, only one of the two clamp brackets 36, i.e., the one closer to the viewer, is shown in FIG. 1 whereas only one of the clamp brackets 36 which is on the far side is shown in FIG. 2. Note also that the swivel bracket 38 is not illustrated in FIG. 1. A tilt shaft 40 is mounted to extend in a horizontal direction on upper end portions of the clamp brackets 36.

Referring to FIG. 2, the swivel bracket 38 includes a platy main body portion 42 which is substantially parallel to a rear end portion of the boat body 34 (see FIG. 1); and an arm portions 44 (FIG. 2 shows only one arm portion 44 on the side closer to the viewer) arranged on an upper portion of the main body portion 42, to extend from two respective sides toward the boat body 34. The pair of arm portions 44 are both mounted pivotably around the tilt shaft 40. Thus, the swivel bracket 38 is pivotable to the clamp brackets 36 in the up-down direction.

At a widthwise (horizontal) center portion in the main body portion 42, a rotatable steering shaft 46 extends in the up-down direction. The upper case 20 (see FIG. 1) of the propelling apparatus main body 12 (see FIG. 1) is attached to an upper end portion and a lower end portion of the steering shaft 46. Thus, the propelling apparatus main body 12 is pivotable horizontally around the steering shaft 46.

In a center portion in the up-down direction of the main body portion 42, a pair of recesses 42*a* (FIG. 2 shows only one recess 42*a* on the side closer to the viewer) are arranged to be spaced from each other in the widthwise direction. In each of the recesses 42*a*, a projection 48 projects toward the boat body 34. Each of the projections 48 has a lower side where a trim receiver 50 is attached pivotably. Each trim receiver 50 has a concavely curved surface 52. The arm portions 44 of the swivel bracket 38 have a connecting shaft 54 which extends horizontally through the arm portions 44 at a side closer to the main body portion 42. The connecting shaft 54, which is inserted through annular member 72 to be described later, is moved in the up-down direction as the annular member 72 moves in the up-down direction. Thus, the swivel bracket 38 pivots around the tilt shaft 40.

Referring to FIG. 1 and FIG. 2, the power tilt and trim system 16 is disposed between the clamp brackets 36. Referring to FIG. 3 through FIG. 5, the power tilt and trim system 16 preferably includes a pair of trim devices 56; a tilt device 58 provided between the trim devices 56; a pressure feeder 60 provided above one of the trim devices 56; and a reservoir tank 62 provided above the other of the trim devices 56. The trim device 56 is a preferred embodiment of the hydraulic cylinder device according to the present invention.

Each trim device 56 includes a trim cylinder 64 and a piston rod 66. The tilt device 58 includes a tilt cylinder 68 and a piston rod 70. The piston rod 70 has a tip provided with the annular member 72.

Referring to FIG. 2, each trim cylinder 64 is fixed to a corresponding one of the clamp brackets 36. The tilt cylinder 68 is mounted pivotably to a connecting shaft 68*a* which is fixed to the clamp brackets 36.

Referring to FIG. 3 through to FIG. 5, the pressure feeder 60 preferably includes, e.g., a hydraulic pump and a motor which drives the hydraulic pump, and feeds a hydraulic fluid to the trim cylinder 64 and the tilt cylinder 68. The reservoir tank 62 stores the hydraulic fluid which is to be supplied to the trim cylinder 64 and the tilt cylinder 68.

The piston rod 66 of the trim device 56 moves in and out based on the hydraulic pressure of the hydraulic fluid supplied from the reservoir tank 62 to the trim cylinder 64 whereas the piston rod 70 of the tilt device 58 moves in and out based on the hydraulic pressure of the hydraulic fluid supplied from the reservoir tank 62 to the tilt cylinder 68.

Referring to FIG. 2, the piston rod 66 in each trim device 56 has a tip which makes contact with the curved surface 52 of the corresponding trim receiver 50 when the propelling apparatus main body 12 (see FIG. 1) is in the trim range A1 (see FIG. 1). The connecting shaft 54 of the swivel bracket 38 is inserted rotatably through the annular member 72 of the tilt device 58.

Next, an operation of the power tilt and trim system 16 will be described.

Referring to FIG. 1 and FIG. 3, when adjusting the slant angle of the propelling apparatus main body 12 in the trim range A1, the trim devices 56 of the power tilt and trim system 16 is operated. Specifically, the pressure feeder 60 makes an adjustment on the hydraulic pressure of the hydraulic fluid inside the trim cylinder 64, to adjust the amount of travel (position) of the piston rod 66. Referring to FIG. 2, in the trim range A1 (see FIG. 1), the tip of the piston rod 66 is in contact with the trim receiver 50 of the swivel bracket 38, so that the swivel bracket 38 is pivoted around the tilt shaft 40 in the up-down direction, following the in-and-out movement of the piston rod 66. Since the propelling apparatus main body 12 is mounted on the swivel bracket 38 as described earlier, a pivoting action of the swivel bracket 38 causes the propelling apparatus main body 12 to pivot in the trim range A1. In this way, the slant angle of the propelling apparatus main body 12 is adjusted in the trim range A1.

Reference is now made to FIG. 1 and to FIG. 3. When adjusting the slant angle of the propelling apparatus main body 12 in the tilt range A2, the tilt device 58 of the power tilt and trim system 16 is operated. Specifically, with the piston rod 66 of the trim device 56 at its end of extending stroke, the pressure feeder 60 makes an adjustment on the hydraulic pressure of the hydraulic fluid inside the tilt cylinder 68, to adjust the amount of travel (position) of the piston rod 70. Referring to FIG. 2, the piston rod 70 has a tip provided with the annular member 72, which is rotatably penetrated by the connecting shaft 54 that is attached to the swivel bracket 38. Hence, as the piston rod 70 makes an in-and-out movement, and the swivel bracket 38 is pivoted around the tilt shaft 40 in the up-down direction, causing the propelling apparatus main body 12 to pivot in the tilt range A2 (see FIG. 1). This is how the slant angle of the propelling apparatus main body 12 is adjusted in the tilt range A2.

It should be noted here that when the swivel bracket 38 pivots, the connecting shaft 54 moves on an arc which is centered around the tilt shaft 40. This requires that the annular member 72 also has to move like the connecting shaft 54, on an arc which is centered around the tilt shaft 40. In order to achieve this, the tilt cylinder 68 is mounted pivotably to the connecting shaft 68*a* in the tilt device 58 so that the piston rod 70 can tilt in accordance with the position of the connecting shaft 54. This arrangement allows the annular member 72 to move on the arc which is centered around the tilt shaft 40. It should be noted here that while the propelling apparatus main body 12 is being operated in the trim range A1 (see FIG. 1), the piston rod 70 makes an in-and-out movement following the up-and-down movement of the connecting shaft 54.

It should also be noted here that the power tilt and trim system 16 (the pressure feeder 60) is electrically connected with, e.g., a control unit (not illustrated) installed in the boat body 34, and is operated by a human operator who makes control on the control unit.

Figure 6:
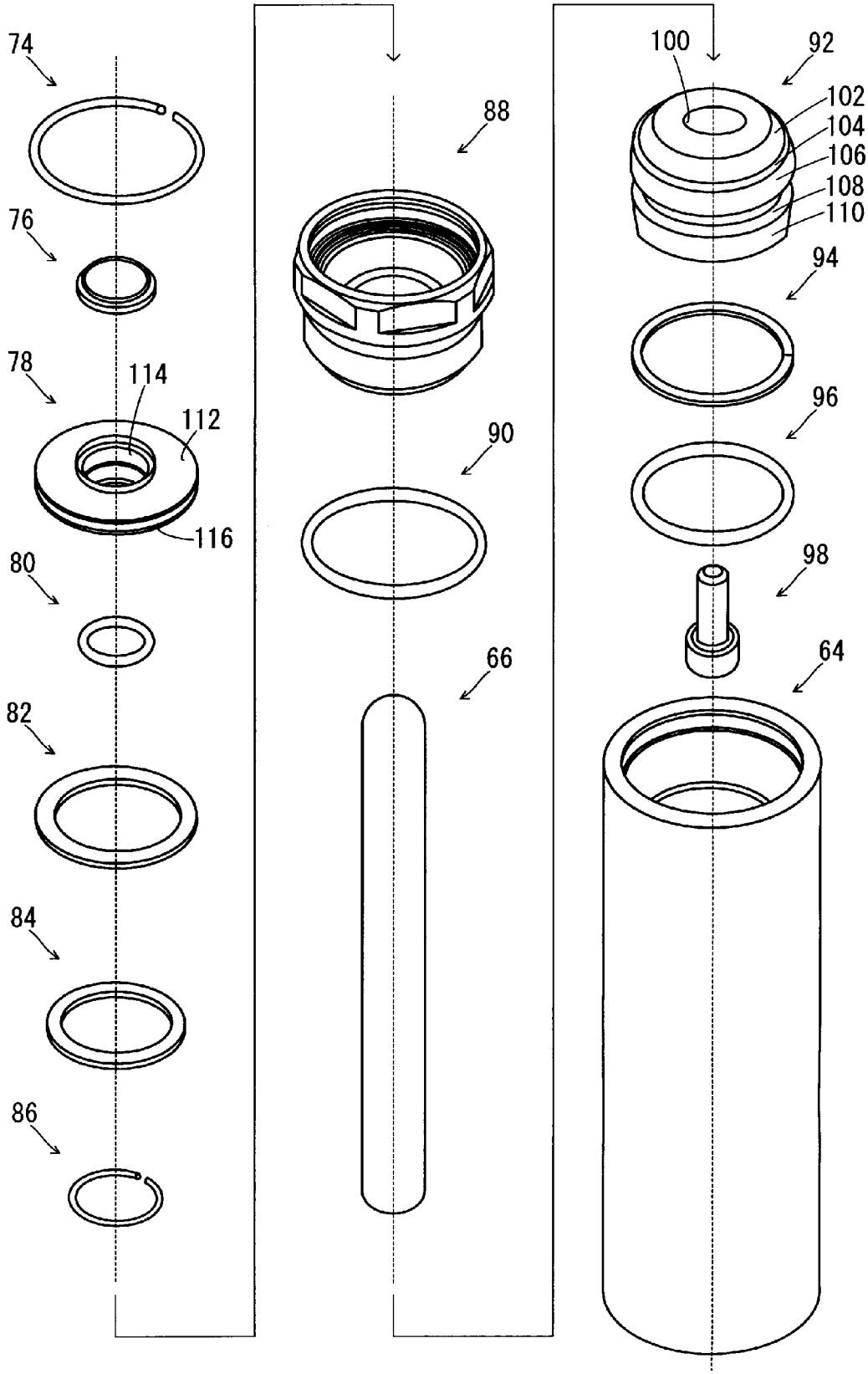
FIG. 6 is an exploded perspective view showing a trim device according to a preferred embodiment of the present invention.
Figure 7:
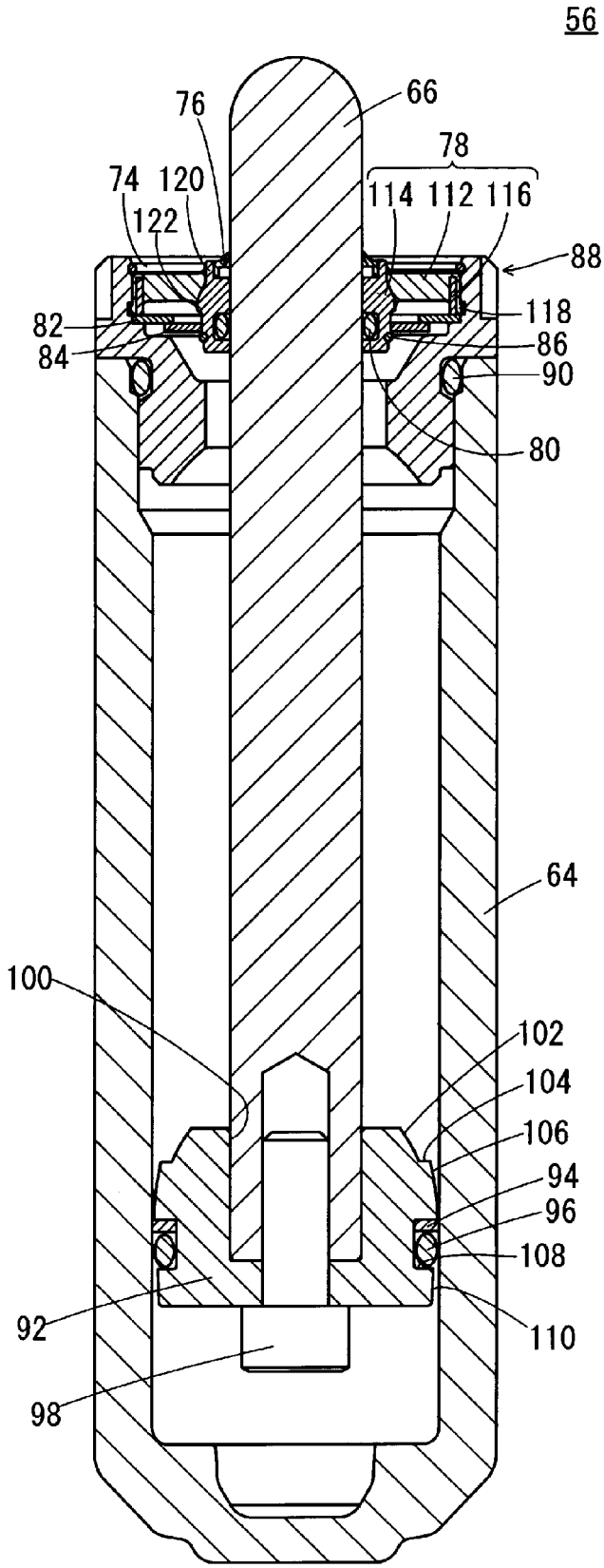
FIG. 7 is a sectional view showing an internal structure of the trim device according to a preferred embodiment of the present invention.
Figure 8:
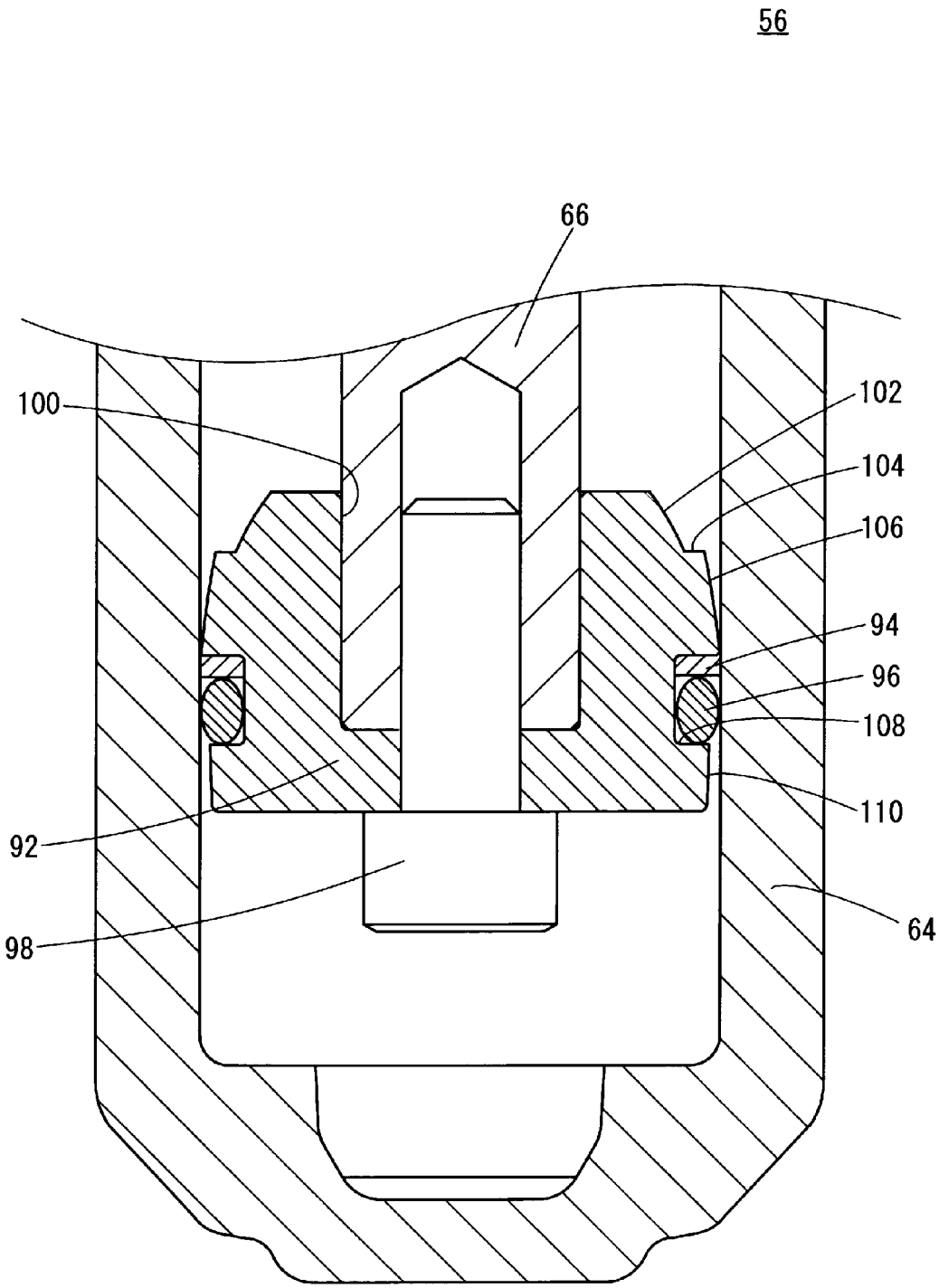
FIG. 8 is an enlarged sectional view showing a rear-end side (a bottom-end side of a trim cylinder) of the trim device according to a preferred embodiment of the present invention.
Figure 9:
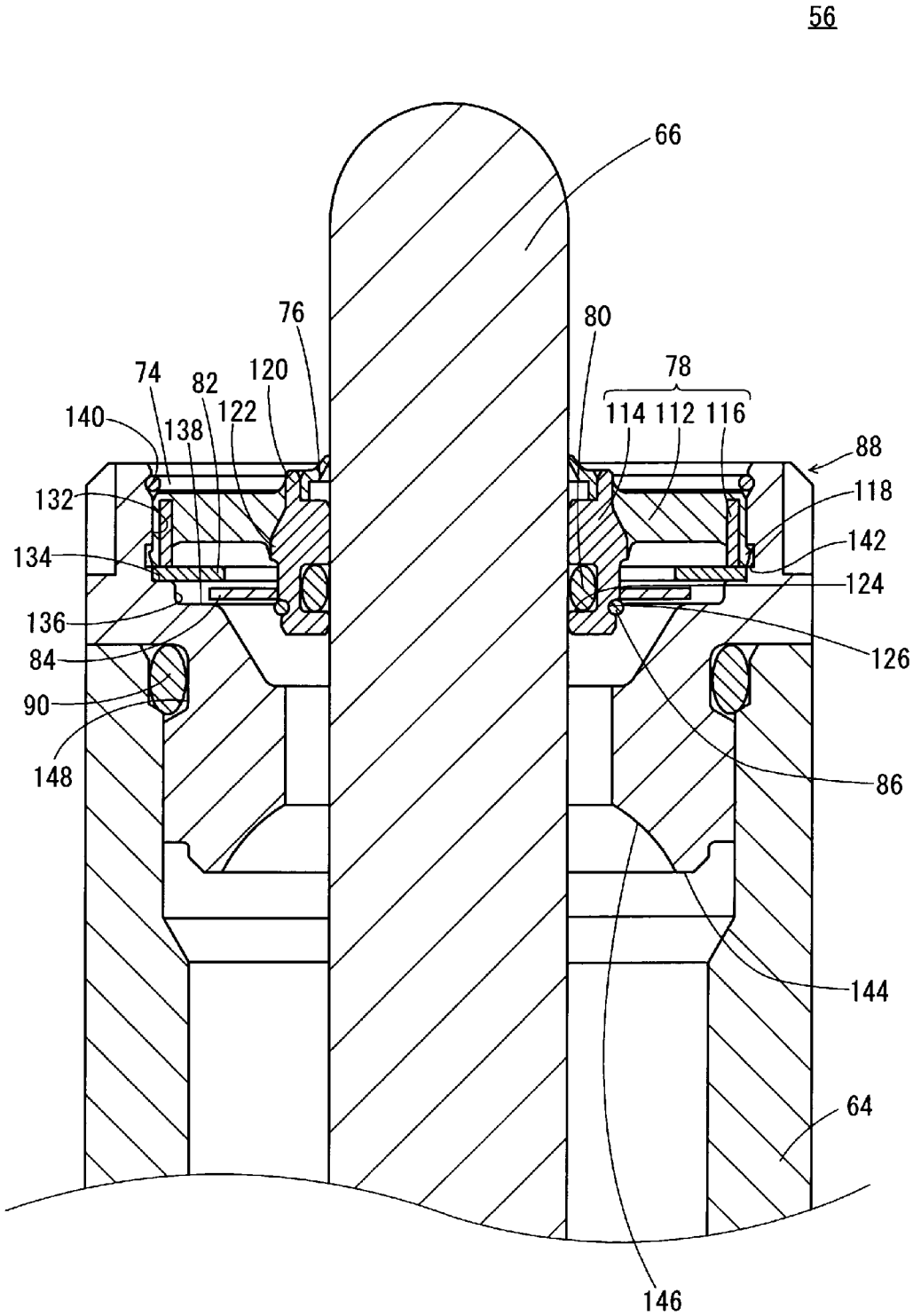
FIG. 9 is an enlarged sectional view showing a tip-portion side (an open-end side of the trim cylinder) of the trim device according to a preferred embodiment of the present invention.

Next, description will cover a construction of the trim device 56. FIG. 6 is an exploded perspective view of the trim device 56. FIG. 7 is a sectional view showing an internal structure of the trim device 56. FIG. 8 is an enlarged sectional view showing a rear-end side (a bottom-end side of the trim cylinder 64) of the trim device 56 in FIG. 7 whereas FIG. 9 is an enlarged sectional view showing a tip-portion side (an open-end side of the trim cylinder 64) of the trim device 56 in FIG. 7.

As shown in FIG. 6, the trim device 56 preferably includes a circlip 74, a dust seal 76, a support member 78, an O ring 80, an outer stopper 82, an inner stopper 84, a circlip 86, a cylinder cap 88, an O ring 90, a piston rod 66, a piston 92, a backup ring 94, an O ring 96, a bolt 98 and a trim cylinder 64. It should be noted here that in the following description of these constituent elements, the up-down direction will be determined in reference to the trim device 56 as a completed assembly. More specifically, the side closer to the tip of trim device 56 (the open-end side of the trim cylinder 64) will be called the up side whereas a rear-end side of the trim device 56 (the bottom-end side of the trim cylinder 64) will be called the down side.

Referring to FIG. 6 through FIG. 8, the trim cylinder 64 has an inner circumferential surface which preferably has a circular cross-section. The piston rod 66 preferably has a circular columnar shape, having a spherically curved tip portion (upper end portion). The piston 92 preferably is generally circular columnar, and is slidable inside the trim cylinder 64 in an axial direction of the trim cylinder 64. The piston 92 has a hole 100 for insertion of a lower end portion of the piston rod 66. The piston rod 66 is inserted in the hole 100 and under this state, fixed to the piston 92 with the bolt 98. The trim cylinder 64 has an upper end portion and a lower end portion, each having a fluid inlet/outlet port (not illustrated) for hydraulic fluid to move in and out. The piston 92 moves axially of the trim cylinder 64 based on a hydraulic pressure of the hydraulic fluid which is charged and discharged via these fluid inlet/outlet.

The piston 92 has an outer circumferential surface which preferably includes, naming from its top end and downward, a partial spherical surface 102, the engagement surface 104, a partial spherical surface 106, a groove 108 and a partial conical surface 110. The partial spherical surface 102 is curved spherically at a curvature which is substantially equal to a curvature of a virtual sphere R (see FIG. 13 to be described later) which is centered around a pivot center C (see FIG. 13 to be described later) of the piston 92. The engagement surface 104 is arranged to face the cylinder cap 88. The partial spherical surface 106 is curved spherically. The groove 108 is formed in the outer circumferential surface of the piston 92, circumferentially thereof. The partial conical surface 110 is conically curved.

Referring to FIG. 8, the backup ring 94 and the O ring 96 are fitted into the groove 108. The O ring 96 provides sealing between the inner circumferential surface of the trim cylinder 64 and the outer circumferential surface of the piston 92. The backup ring 94 prevents the O ring 96 from being pushed out of the groove 108 by the hydraulic pressure of the hydraulic fluid when the pressure has increased on the bottom end side of the trim cylinder 64.

In the present preferred embodiment, a diameter of the partial spherical surface 106 at its lower end provides a maximum diameter of the piston 92. The piston 92 is capable of making its sliding movement smoothly, with the partial spherical surface 106 staying in contact with the inner circumferential surface of the trim cylinder 64.

Referring to FIG. 6, FIG. 7 and FIG. 9, the support member 78 includes a generally annular tilt allowance member 112; a generally cylindrical inner circumferential metal 114 which is fixed on an inner circumferential side of the tilt allowance member 112; and a cylindrical outer circumferential metal 116 (see FIG. 7 and FIG. 9) which is fixed on an outer circumferential portion of the tilt allowance member 112. In the support member 78, all of the tilt allowance member 112, the inner circumferential metal 114 and the outer circumferential metal 116 are axially in alignment with the trim cylinder 64 when there is no load applied. The tilt allowance member 112 may be made of an elastic material such as rubber and fiber (fabric), for example. The inner circumferential metal 114 and the outer circumferential metal 116 may be made of such a metal as aluminum and stainless steel, for example.

Referring to FIG. 9, the tilt allowance member 112 includes a protruded portion 118 protruding circumferentially on a lower end portion of its outer circumferential surface. The tilt allowance member 112 allows the outer circumferential metal 116 to expose its bottom surface and a lower portion of its inner circumferential surface.

The support member 78 is manufactured so that it will provide axial alignment of the tilt allowance member 112, the inner circumferential metal 114 and the outer circumferential metal 116. Specifically, for example, the support member 78 is produced by first disposing the inner circumferential metal 114 and the outer circumferential metal 116 in predetermined respective places in a metal mold, then injecting a material (e.g., rubber) into the mold, and then allowing the material to set to form the tilt allowance member 112.

The inner circumferential metal 114 has a ridged portion 120, a bulged portion 122, an inner circumferential groove 124 and an outer circumferential groove 126. The ridged portion 120 is like a circular wall rising in the upward direction on an upper end portion of the inner circumferential metal 114. The bulged portion 122 is a circumferential bulge in a substantially intermediate portion of the outer circumferential surface of the inner circumferential metal 114. The inner circumferential groove 124 is formed in a lower portion of an inner circumferential surface of the inner circumferential metal 114, along the circumferential direction. The outer circumferential groove 126 is formed in a lower portion of the outer circumferential surface of the inner circumferential metal 114, in the circumferential direction.

The inner circumferential metal 114 is slidable with respect to the piston rod 66. The dust seal 76 is pressed into the ridged portion 120. The dust seal 76 prevents foreign matters (dust, etc.) from entering the trim cylinder 64 while preventing leakage of the hydraulic fluid from the trim cylinder 64. The O ring 80 is fitted into the inner circumferential groove 124, providing a sealing between the inner circumferential metal 114 and the piston rod 66.

The annular outer stopper 82 and the inner stopper 84 are provided on the lower end side of the inner circumferential metal 114. The inner stopper 84 is slidable with respect to the inner circumferential metal 114. The circlip 86, which is fitted into the outer circumferential groove 126, prevents the inner stopper 84 from falling off. The bulged portion 122 has an outer diameter which is greater than an inner diameter of the inner stopper 84. Therefore, the inner stopper 84 has a limited stroke of travel, which is between the bulged portion 122 and the circlip 86. It should be noted here that the outer stopper 82 and the inner stopper 84 may be made of such a material as a metallic material (aluminum, stainless steel, etc.) and a resin material, for example.

Figure 10:
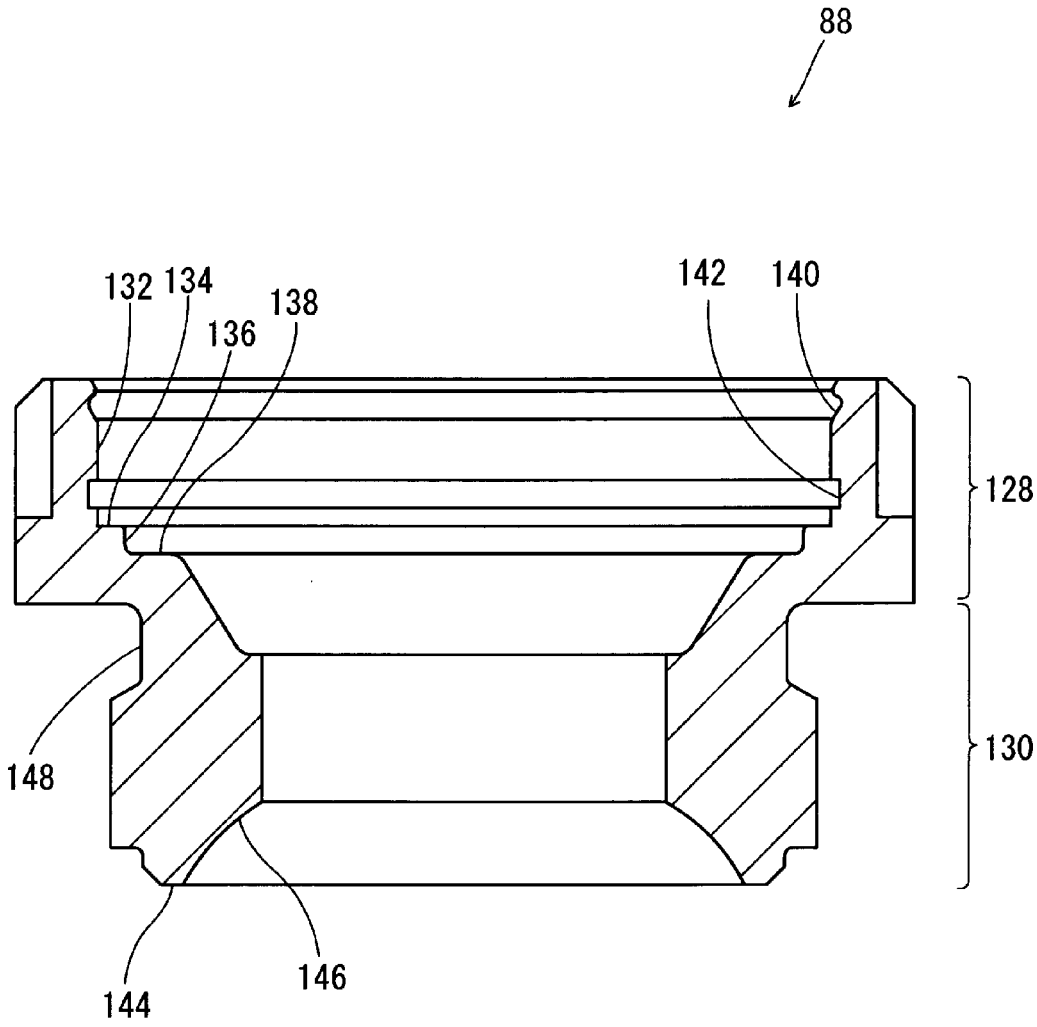
FIG. 10 is a sectional view of a cylinder cap.

Referring to FIG. 10, the cylinder cap 88 includes a generally cylindrical large-diameter portion 128, and a small-diameter portion 130 which has an outer diameter that is smaller than that of the large-diameter portion 128. The large-diameter portion 128 has, on its inner circumferential surface and naming from the top, a cylindrical surface 132 which has a circular cross-section, an annular engagement surface 134, a cylindrical surface 136 which has a circular cross-section, and an annular engagement surface 138. The cylindrical surface 136 has a diameter which is smaller than that of the cylindrical surface 132. The engagement surface 134 and the engagement surface 138 are perpendicular or substantially perpendicular to the up-down direction (the axial direction of the cylinder cap 88). The cylindrical surface 132 has grooves 140 and 142 respectively on its upper side and lower side. The grooves 140, 142 are formed circumferentially of the cylindrical surface 132.

The small-diameter portion 130 includes an annular engagement surface 144 provided at a lower end thereof; a partial spherical surface 146 extending continuously from an inner edge of the engagement surface 144 and curving spherically in the upward direction; and an outer circumferential groove 148 formed in the circumferential direction. The partial spherical surface 146 has a curvature which is substantially equal to that of the partial spherical surface 102 (see FIG. 8) in the piston 92.

Referring to FIG. 9 and FIG. 10, the cylinder cap 88 has an inner circumferential surface which has a minimum diameter larger than the diameter of the piston rod 66. The engagement surface 134 has an inner diameter which is smaller than an outer diameter of the outer stopper 82. The outer stopper 82 is supported by the engagement surface 134. The cylindrical surface 132 has a diameter which is substantially equal to an outer diameter of the outer stopper 82.

The cylindrical surface 132 prevents radial movement of the outer stopper 82. The engagement surface 138 has an inner diameter which is smaller than an outer diameter of the inner stopper 84. The engagement surface 138 prevents downward movement of the inner stopper 84. The cylindrical surface 136 has a diameter which is larger than an outer diameter of the inner stopper 84. The inner stopper 84 is movable inside the cylindrical surface 136 radially of the cylinder cap 88. The cylindrical surface 136 has a height (a length in the up-down direction) which is greater than a thickness of the inner stopper 84. The inner stopper 84 is movable between the outer stopper 82 and the engagement surface 138 in the up-down direction.

The tilt allowance member 112 in the support member 78 is pressed into the cylindrical surface 132 so that the outer circumferential metal 116 has its bottom surface contacting an upper surface of the outer stopper 82 and the protruded portion 118 sits in the groove 142. Thus, the outer circumferential metal 116 secures the outer stopper 82 while the protruded portion 118 prevents the tilt allowance member 112 from moving upward. For assured prevention of the tilt allowance member 112 from moving upward, the circlip 74 is fitted into the groove 140 in the cylindrical surface 132.

A screw thread (not illustrated) is formed in an upper end portion of the inner circumferential surface of the trim cylinder 64, as well as in the outer circumferential surface of the small-diameter portion 130 of the cylinder cap 88. In the present preferred embodiment, the small-diameter portion 130 and the trim cylinder 64 are threaded together with each other so that the upper end surface of the trim cylinder 64 makes contact with the large-diameter portion 128. In the small-diameter portion 130, the groove 148 is fitted with the O ring 90, which provides sealing between the trim cylinder 64 and the cylinder cap 88.

It should be noted here that the support member 78 is assembled to the cylinder cap 88 as follows. First, a lower end side of the inner circumferential metal 114 is inserted into the outer stopper 82 and the inner stopper 84, and the circlip 86 is attached to the inner circumferential metal 114. This completes an assembly of the outer stopper 82 and the inner stopper 84 to the inner circumferential metal 114. Next, the tilt allowance member 112 (the support member 78) is pressed into the cylindrical surface 132, and the circlip 74 is attached. This completes the assembling process of the support member 78 to the cylinder cap 88.

In the present preferred embodiment, the trim cylinder 64 preferably defines the cylinder according to a preferred embodiment of the present invention, the tilt allowance member 112 defines the elastic member, the circlip 86 or the bulged portion 122 represents the first stopper portion, the outer stopper 82 or the engagement surface 138 represents the second stopper portion, the cylinder cap 88 serves as the limiting portion, the partial spherical surface 146 represents the first curved surface, the partial spherical surface 102 represents the second curved surface, the engagement surface 104 represents the first engagement surface, and the engagement surface 144 represents the second engagement surface.

Figure 11:
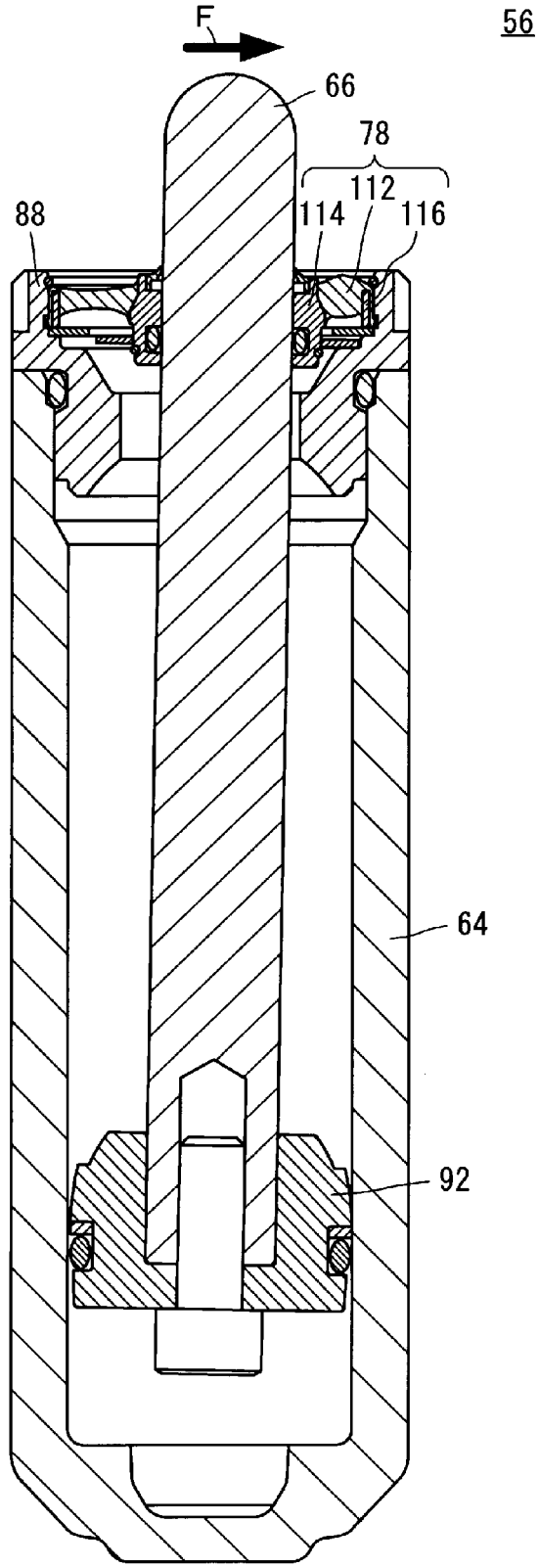
FIG. 11 is a sectional view showing an internal state of the trim device when the piston rod is subjected to an external radial force.
Figure 12:
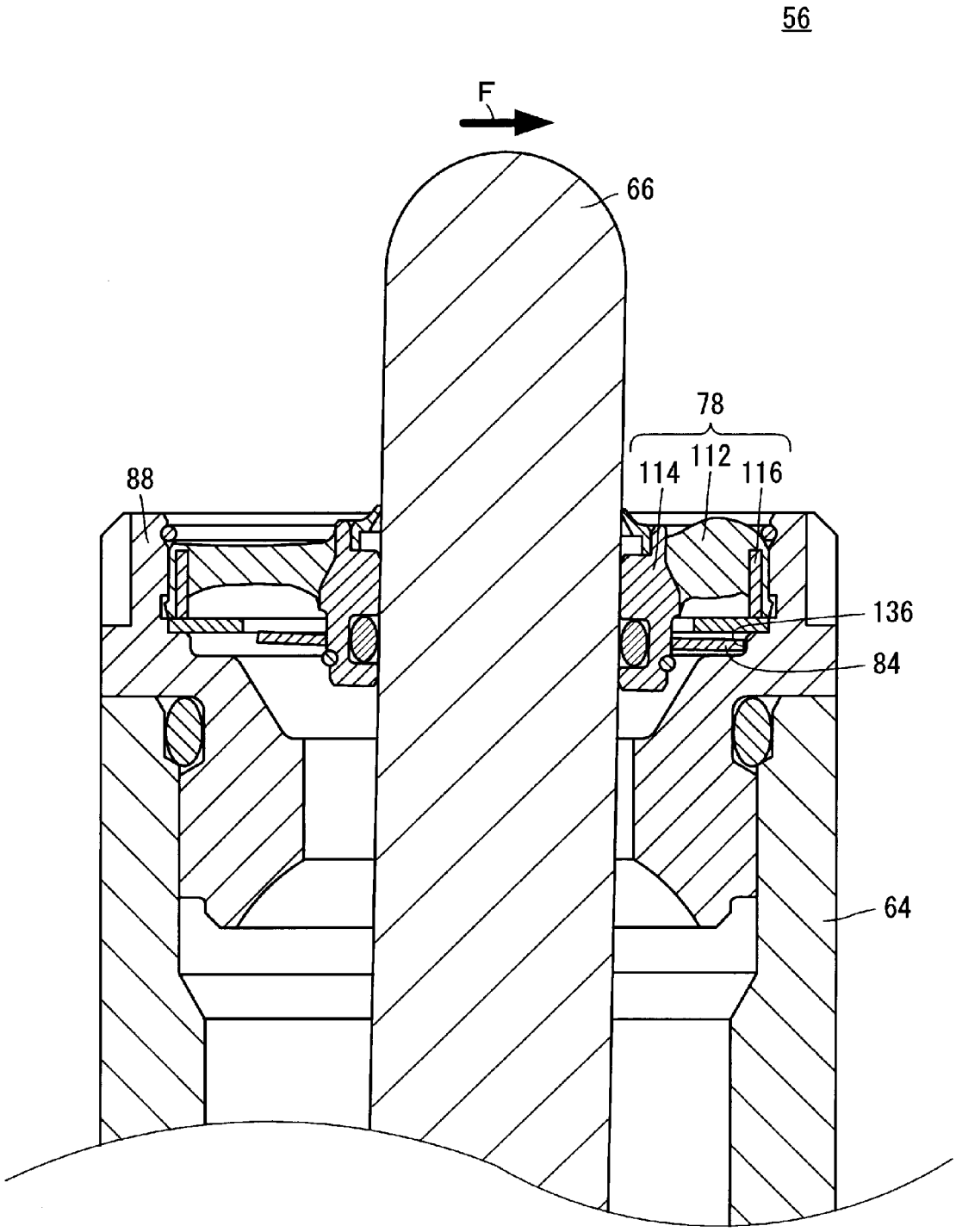
FIG. 12 is an enlarged sectional view showing an internal state of the trim device when the piston rod is subjected to an external axial force.

Next, description will cover functions and advantages of the present preferred embodiment. In the trim device 56 and the boat propelling apparatus 10 which are preferred embodiments of the present invention, the piston rod 66 has its lower end portion fixed to the pivotable piston 92, and the piston rod 66 has its outer circumferential surface supported by the support member 78 which includes the tilt allowance member 112 that is made of an elastic material. As shown in FIG. 11 and FIG. 12 therefore, when an external force F is applied radially to the piston rod 66, the tilt allowance member 112 makes an elastic deformation, allowing the axial center of the piston rod 66 to tilt (lean) with respect to the axial center of the trim cylinder 64. For example, when a frictional force is generated at a place of contact between the tip of the piston rod 66 and the trim receiver 50 (see FIG. 2), the axial center of the piston rod 66 tilts with respect to the axial center of the trim cylinder 64 in a direction where an increase in the frictional force is reduced. This prevents the frictional force from increasing rapidly at the place of contact between the piston rod 66 and the trim receiver 50, preventing the stick-slip phenomenon.

Also, when an impact is applied to the piston rod 66, the impact energy is absorbed by the elastic tilt allowance member 112, so it is possible to prevent a large impact force from reaching other constituent members of the trim device 56. Likewise, if there is vibration in the piston rod 66, the vibration is absorbed by the tilt allowance member 112, so it is possible to prevent a large vibration from reaching other constituent members of the trim device 56.

The outer circumferential metal 116 is provided on an outer circumference side of the tilt allowance member 112. This reduces deformation of an outer circumferential portion of the tilt allowance member 112 (especially an outer-side portion of the outer circumferential metal 116). As shown in FIG. 12, therefore, even when the tilt allowance member 112 makes deformation, the outer circumferential surface of the tilt allowance member 112 does not come off the inner circumferential surface of the cylinder cap 88, thereby preventing leakage of the hydraulic fluid from inside the cylinder cap 88 to the outside.

Under a no load situation, the tilt allowance member 112, the inner circumferential metal 114 and the outer circumferential metal 116 in the support member 78 are all in axial alignment. Therefore, even if the inner circumferential metal 114 comes off the axial center of the outer circumferential metal 116, the tilt allowance member 112 urges the inner circumferential metal 114 so that the inner circumferential metal 114 will become aligned with the outer circumferential metal 116. It should be appreciated that the outer circumferential metal 116 is designed to be in axial alignment with the trim cylinder 64. Therefore, the piston rod 66, which is supported by the inner circumferential metal 114, is under an urging force from the tilt allowance member 112 so that the piston rod 66 is in axial alignment with the trim cylinder 64. For this reason, the axial center of the piston rod 66 is automatically adjusted so that the piston rod 66 is in axial alignment with the trim cylinder 64 when the hydraulic pressure of the hydraulic fluid inside the trim cylinder 64 is not large (when the piston 92 is not under a large pressure). This prevents such a situation, for example, that the piston rod 66 starts its travel while it is tilted with respect to the axial center of the trim cylinder 64 when the trim device 56 is started (when the piston 92 is at the lower end of the trim cylinder 64). Since this arrangement allows the piston rod 66 to make appropriate contact with the trim receiver 50 (see FIG. 2), an operating force is transmitted efficiently from the piston rod 66 to the trim receiver 50. As a result, a smooth adjustment is possible on the slant angle of the propelling apparatus main body 12.

Referring to FIG. 12, the tilting (leaning) movement of the piston rod 66 is stopped when the outer circumferential surface of the inner stopper 84 makes contact with the cylindrical surface 136 of the cylinder cap 88. Since this prevents excessive deformation of the tilt allowance member 112, the arrangement reduces deterioration of the tilt allowance member 112.

Figure 13:
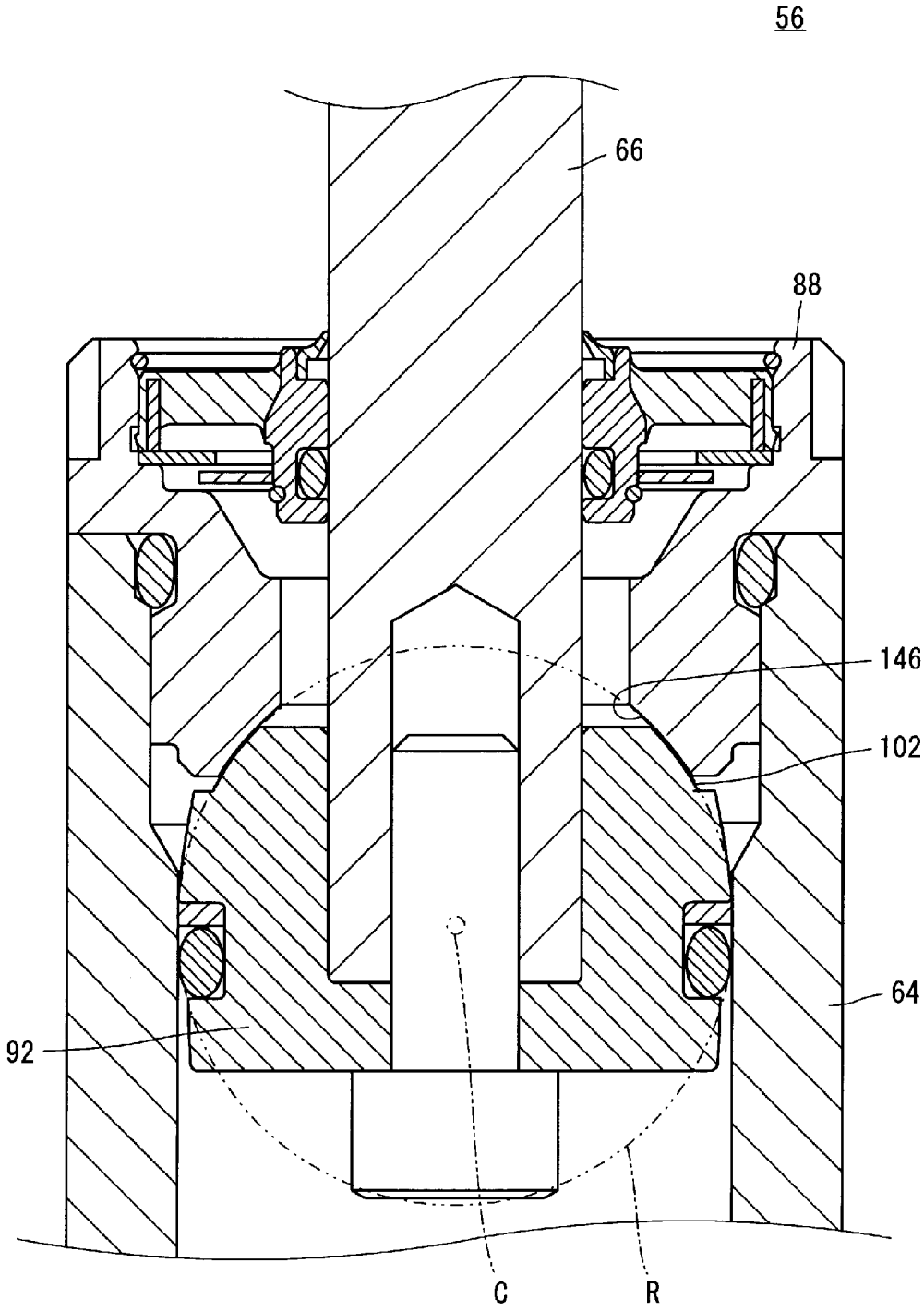
FIG. 13 is an enlarged sectional view showing an internal state of the trim device when the piston rod is extended to its limit.
Figure 14:
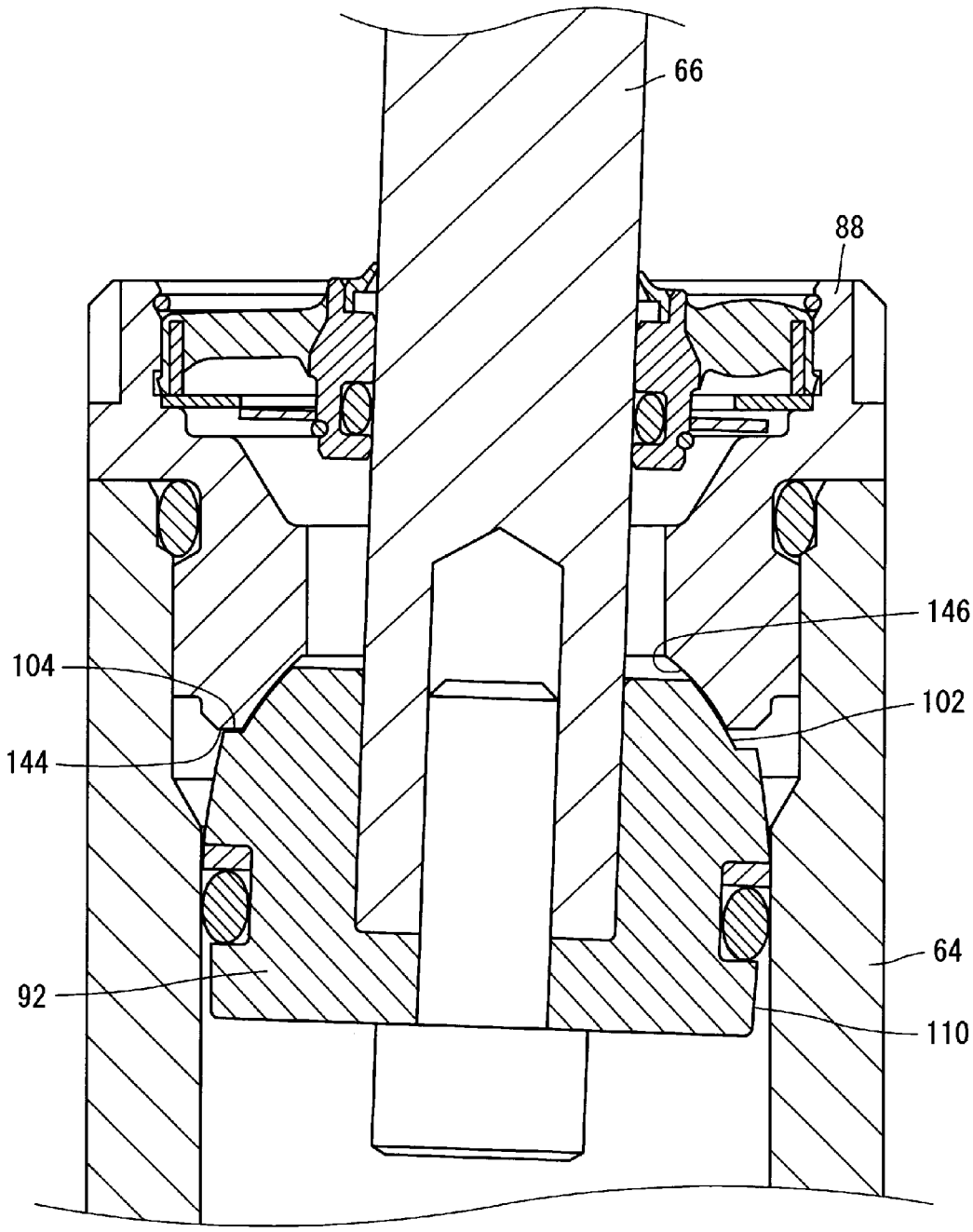
FIG. 14 is an enlarged sectional view showing an internal state of the trim device when the piston rod is extended to its limit, and tilted.

Referring to FIG. 13, an upward travel of the piston 92 is stopped when the partial spherical surface 102 makes contact with the partial spherical surface 146 of the cylinder cap 88. The curvature of the partial spherical surface 102 and that of the partial spherical surface 146 are substantially equal to the curvature of the virtual sphere R which is centered around a pivot center C of the piston 92. Therefore, as shown in FIG. 14, while the partial spherical surface 102 is in contact with the partial spherical surface 146, the piston 92 is pivotable due to a slip action of the partial spherical surface 102 with respect to the partial spherical surface 146. This allows the piston rod 66 to tilt with respect to the axial center of the trim cylinder 64 even when the piston rod 66 is in its fully extended state. Also, since the contact between the partial spherical surface 102 and the partial spherical surface 146 provides stable support to the piston, the piston rod 66 is tilted but is stable even when the piston rod 66 is in its fully extended state with respect to the trim cylinder 64.

Also, the pivotal movement of the piston 92 is stopped when, as shown in FIG. 14, the engagement surface 104 of the piston 92 makes a contact with the engagement surface 144 of the cylinder cap 88. This prevents the piston rod 66 from assuming an excessively large tilting (leaning) angle under the state where the piston rod 66 is fully extended. Now, in the boat propelling apparatus 10 (see FIG. 1), the trim receiver 50 (see FIG. 2) is not in contact with the piston rod 66 while the propelling apparatus main body 12 is in operation in the tilt range A2 (see FIG. 1), but comes back into contact again with the piston rod 66 when the propelling apparatus main body 12 moves from the tilt range A2 to the trim range A1 (see FIG. 1). Therefore, if the piston rod 66 has an excessively large slant angle when the propelling apparatus main body 12 moves from the tilt range A2 to the trim range A1, the tip of the piston rod 66 can make incidental contact with a position which is unduly off the center of the trim receiver 50. This poses a risk of vibration to be produced when the piston rod 66 and the trim receiver 50 make contact with each other. With this in consideration, the slant angle of the trim cylinder 64 is limited as described above in order to ensure a smooth contact between the piston rod 66 and the trim receiver 50. Preferably, the slant angle of the axial center of the trim cylinder 64 with respect to the axial center of the piston 92 is controlled not to become greater than about 10 degrees, for example, through an appropriate determination process of various dimensions in the cylinder cap 88 and the piston 92.

Figure 15:
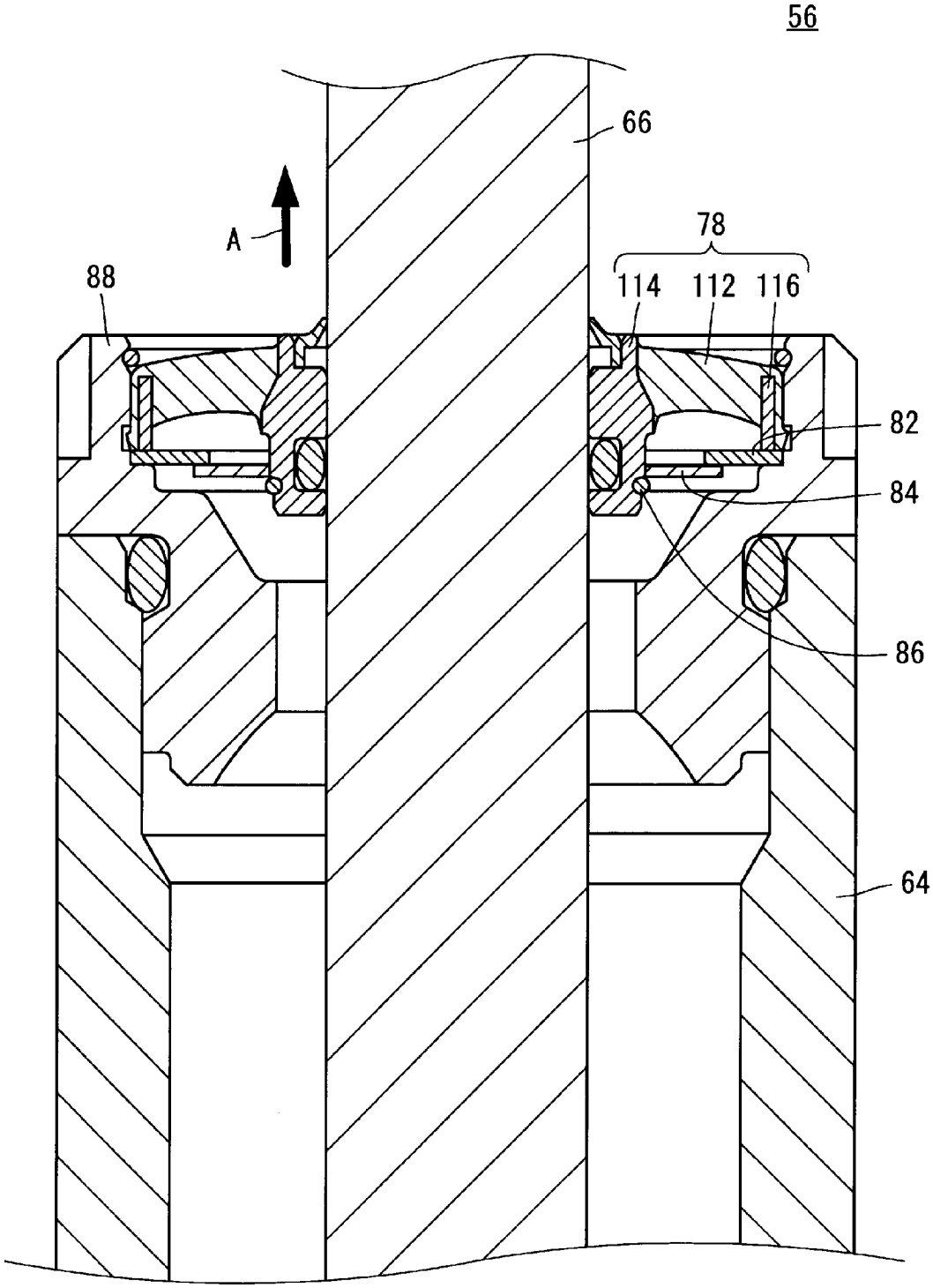
FIG. 15 is an enlarged sectional view showing an internal state of the trim device when the piston rod is moving upward.

Referring to FIG. 15, when the piston rod 66 moves upward (in the direction indicated by Arrow A), the inner circumferential metal 114 of the support member 78 moves upward, following the movement of the piston rod 66. In this process, the inner stopper 84 moves upward together with the inner circumferential metal 114, being captured by the circlip 86, but then stops the upward movement when captured by the outer stopper 82 which is prevented from moving axially of the trim cylinder 64. This stops the upward movement of the inner circumferential metal 114, preventing the tilt allowance member 112 from being excessively deformed. As a result, the arrangement reduces deterioration of the tilt allowance member 112.

Figure 16:
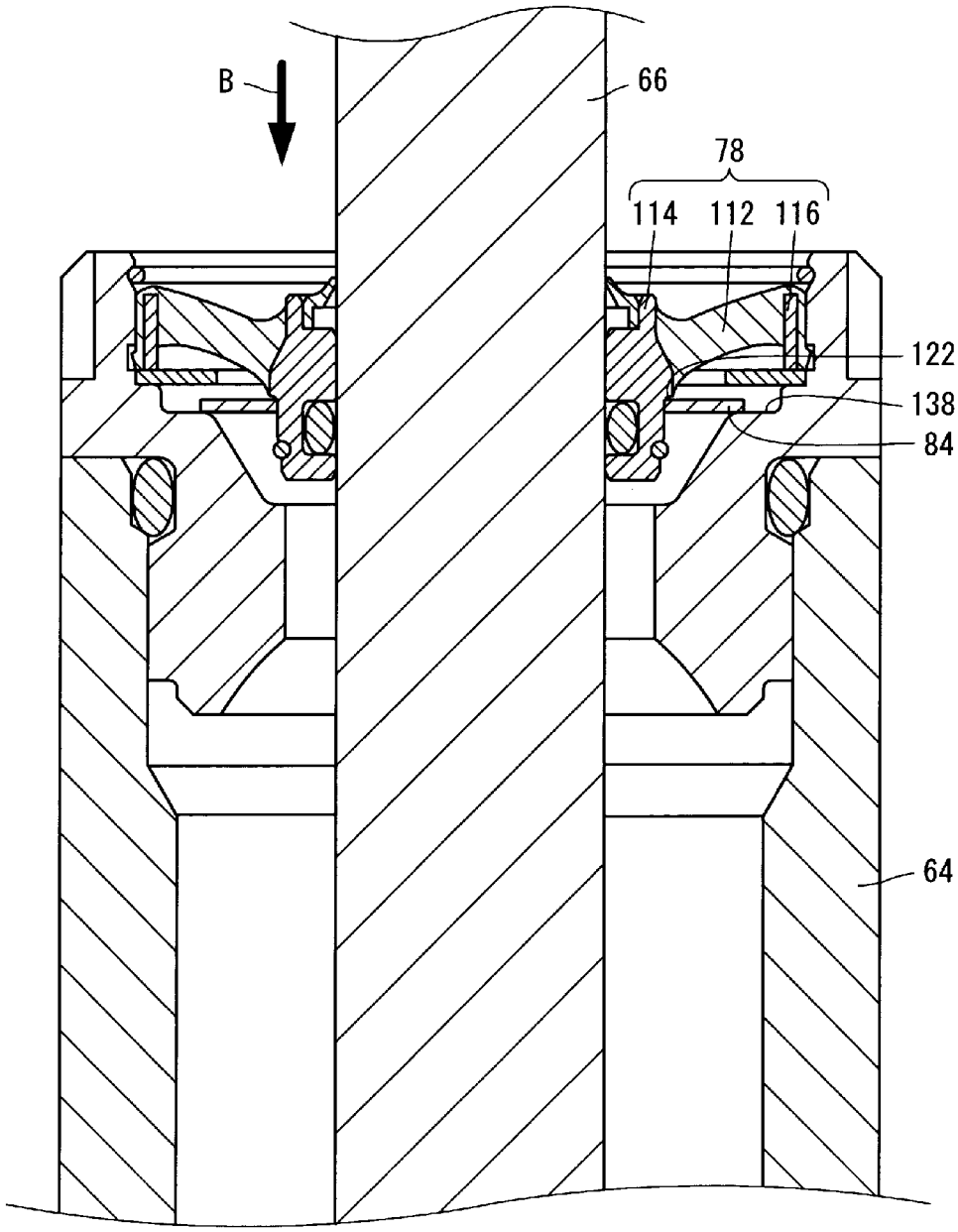
FIG. 16 is an enlarged sectional view showing an internal state of the trim device when the piston rod is moving downward.

Referring to FIG. 16, when the piston rod 66 moves downward (the direction indicated by Arrow B), the inner circumferential metal 114 of the support member 78 moves downward, following the movement of the piston rod 66. In this process, the inner stopper 84 moves downward together with the inner circumferential metal 114, being captured by the bulged portion 122 of the inner circumferential metal 114, but then stops the downward movement when captured by the engagement surface 138 of the cylinder cap 88 which is prevented from moving axially of the trim cylinder 64. This stops the downward movement of the inner circumferential metal 114, preventing the tilt allowance member 112 from being excessively deformed. Thus, the arrangement reduces deterioration of the tilt allowance member 112.

It should be noted here that in the above-described preferred embodiment, the support member 78 preferably includes the tilt allowance member 112, the inner circumferential metal 114 and the outer circumferential metal 116 as shown in FIG. 9. However, the constitution of the support member is not limited to those given in the example described above. For example, the support member may not include the inner circumferential metal 114 and the outer circumferential metal 116. In this case, the inner diameter of the tilt allowance member is made smaller than the inner diameter of the above-described the tilt allowance member 112 in order to allow the tilt allowance member's inner circumferential surface to make contact with the outer circumferential surface of the piston rod 66. Another example may be that the inner circumferential metal 114 may be replaced by a resin member which is formed to have the same shape as the inner circumferential metal 114. Likewise, the outer circumferential metal 116 may be replaced by a resin member that is formed to have the same shape as the outer circumferential metal 116.

As shown in FIG. 9, the trim cylinder 64 and the cylinder cap 88 are preferably separate members in the above-described preferred embodiment. However, the trim cylinder and the cylinder cap may be provided as single individual pieces. More specifically, the arrangement may be that a trim cylinder has an upper end portion which preferably has the same inner circumferential surface as that of the cylinder cap 88, and this trim cylinder preferably includes the support member 78, the circlip 74, the outer stopper 82 and the inner stopper 84.

As shown in FIG. 14, pivotal movement of the piston 92 is preferably limited by contact between the engagement surface 104 of the piston 92 and the engagement surface 144 of the cylinder cap 88 in the above-described preferred embodiment. However, pivotal movement of the piston 92 may be limited by contact between the partial conical surface 110 of the piston 92 and the inner circumferential surface of the trim cylinder 64.

Also, in the above-described preferred embodiment, the piston 92 is pivotable in the trim cylinder 64. However, the piston rod 66 may be pivotably connected with the piston 92.

Figure 17:
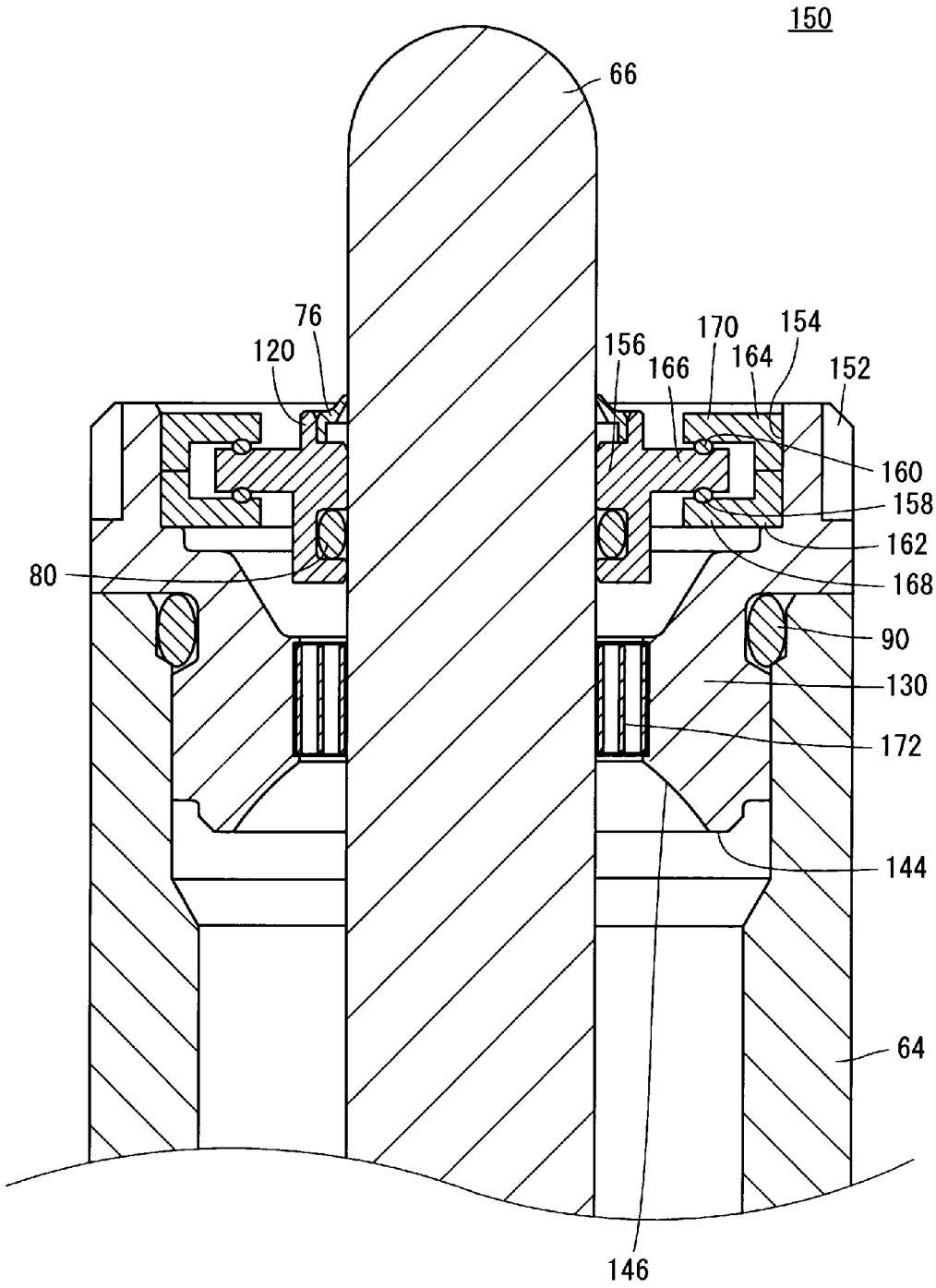
FIG. 17 is a sectional view showing another example of the trim device.

The trim device may have a construction as shown in FIG. 17. It should be noted here that FIG. 17 shows a section of an upper end portion of a trim device. FIG. 17 shows a trim device 150, which differs from the trim device 56 in the points described in the following paragraphs.

Referring to FIG. 17, in the trim device 150, the cylinder cap 88 (see FIG. 9) is replaced by a cylinder cap 152 which is fixed to an upper end portion of the trim cylinder 64. The cylinder cap 152 has a cylindrical surface 154 on an upper end side of its inner circumferential surface. The cylindrical surface 154 does not have the grooves 140, 142 (see FIG. 9) but has a screw thread (not illustrated).

Inside the cylinder cap 152, there are provided an inner circumferential metal 156, an O ring 158, 160 and an outer circumferential metals 162, 164, instead of the tilt allowance member 112 (see FIG. 9), the inner circumferential metal 114 (see FIG. 9) and outer circumferential metal 116 (see FIG. 9).

The inner circumferential metal 156 has an outer circumferential surface formed with a flange portion 166 which extends radially outward around its circumference. The outer circumferential metal 162 and the outer circumferential metal 164 are both cylindrical. The outer circumferential metal 162 has a lower end portion provided with an annular flange portion 168 whereas the outer circumferential metal 164 has an upper end portion provided with an annular flange portion 170. Each of the outer circumferential metal 162 and the outer circumferential metal 164 has an outer circumferential surface formed with a screw thread (not illustrated) and is threaded to the cylindrical surface 154 of the cylinder cap 152.

The outer circumferential metal 162 and the outer circumferential metal 164 sandwich the flange portion 166 of the inner circumferential metal 156 by the flange portion 168 and the flange portion 170, and are fixed to the cylinder cap 152. The flange portion 166 has its lower surface spaced from an upper surface of the flange portion 168. The flange portion 166 has its upper surface spaced from a lower surface of the flange portion 170.

The flange portion 166 of the inner circumferential metal 156 has a diameter which is smaller than an inner diameter of the outer circumferential metal 162 (inner diameter of a portion above the flange portion 168) and is also smaller than an inner diameter of the outer circumferential metal 164 (inner diameter of a portion below the flange portion 170). Thus, the inner circumferential metal 156 is radially movable.

The O ring 158 is provided between the flange portion 166 and the flange portion 168. The O ring 160 is provided between the flange portion 166 and the flange portion 170. These O rings prevent the hydraulic fluid inside the trim cylinder 64 from leaking outside, by passing between the inner circumferential metal 156 and the outer circumferential metal 162, and between the inner circumferential metal 156 and the outer circumferential metal 164.

Figure 18:
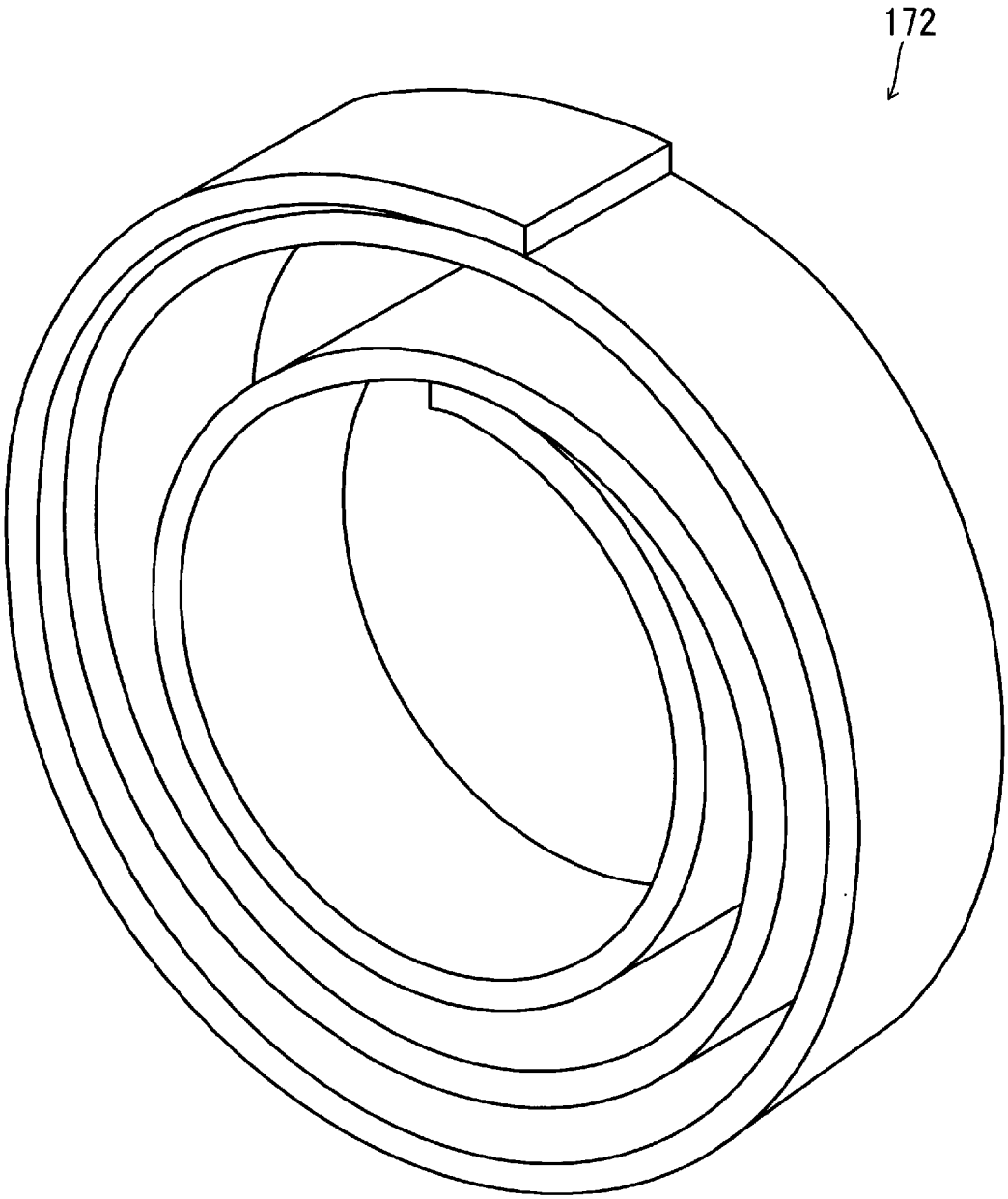
FIG. 18 is a perspective view of a flat spiral spring.

Referring to FIG. 17 and FIG. 18, the small-diameter portion 130 has an inner circumferential surface provided with a flat spiral spring 172. Referring to FIG. 17, the flat spiral spring 172 has its inner circumference surface contacted slidably by the piston rod 66.

In the trim device 150, the flat spiral spring 172 serves as the support member, whereas the inner circumferential metal 156, the O rings 158, 160, the outer circumferential metal 162 and the outer circumferential metal 164 preferably define the sealing members.

Hereinafter, functions and advantages of the trim device 150 will be described.

In the trim device 150, when an external force is applied radially to the piston rod 66, the flat spiral spring 172 makes an elastic deformation, allowing the axial center of the piston rod 66 to tilt with respect to the axial center of the trim cylinder 64. Since this prevents the frictional force from increasing rapidly at the place of contact between the piston rod 66 and the trim receiver 50 (see FIG. 2), the arrangement prevents the stick-slip phenomenon.

Also, when an impact is applied to the piston rod 66, the impact energy is absorbed by the flat spiral spring 172, so it is possible to prevent a large impact force from reaching other constituent members of the trim device 150. Likewise, if there is vibration in the piston rod 66, the vibration is absorbed by the flat spiral spring 172, so it is possible to prevent a large vibration from reaching other constituent members of the trim device 150.

Further, since the piston rod 66 is urged by the flat spiral spring 172 so that the piston rod 66 is in axial alignment with the trim cylinder 64, the axial center position of the piston rod 66 is automatically adjusted in this arrangement.

It should be noted here that the flat spiral spring 172 may be replaced by other elastic members such as one made of rubber, for example.

In the above-described preferred embodiments, the hydraulic cylinder device according to the present invention is preferably applied to a trim device. However, the hydraulic cylinder device according to preferred embodiments of the present invention may be applied to a tilt device. Specifically, for example, the same constituent members as shown in FIG. 6, i.e., the circlip 74, the dust seal 76, the support member 78, the O ring 80, the outer stopper 82, the inner stopper 84, the circlip 86, the cylinder cap 88, the O ring 90, the piston 92, the backup ring 94, the O ring 96 and the bolt 98 may be used to slidably hold the piston rod 70 (see FIG. 3) inside the tilt cylinder 68 (see FIG. 3). In this case, the piston rod 70 makes a tilting movement in accordance with the position of the connecting shaft 54 (see FIG. 2) even if the tilt cylinder 68 is fixed to the clamp brackets 36 (see FIG. 1). Therefore, the tilt cylinder 68 need not be pivotable to the clamp brackets 36. This makes it possible to simplify the mounting structure of the tilt cylinder 68.

Figure 19:
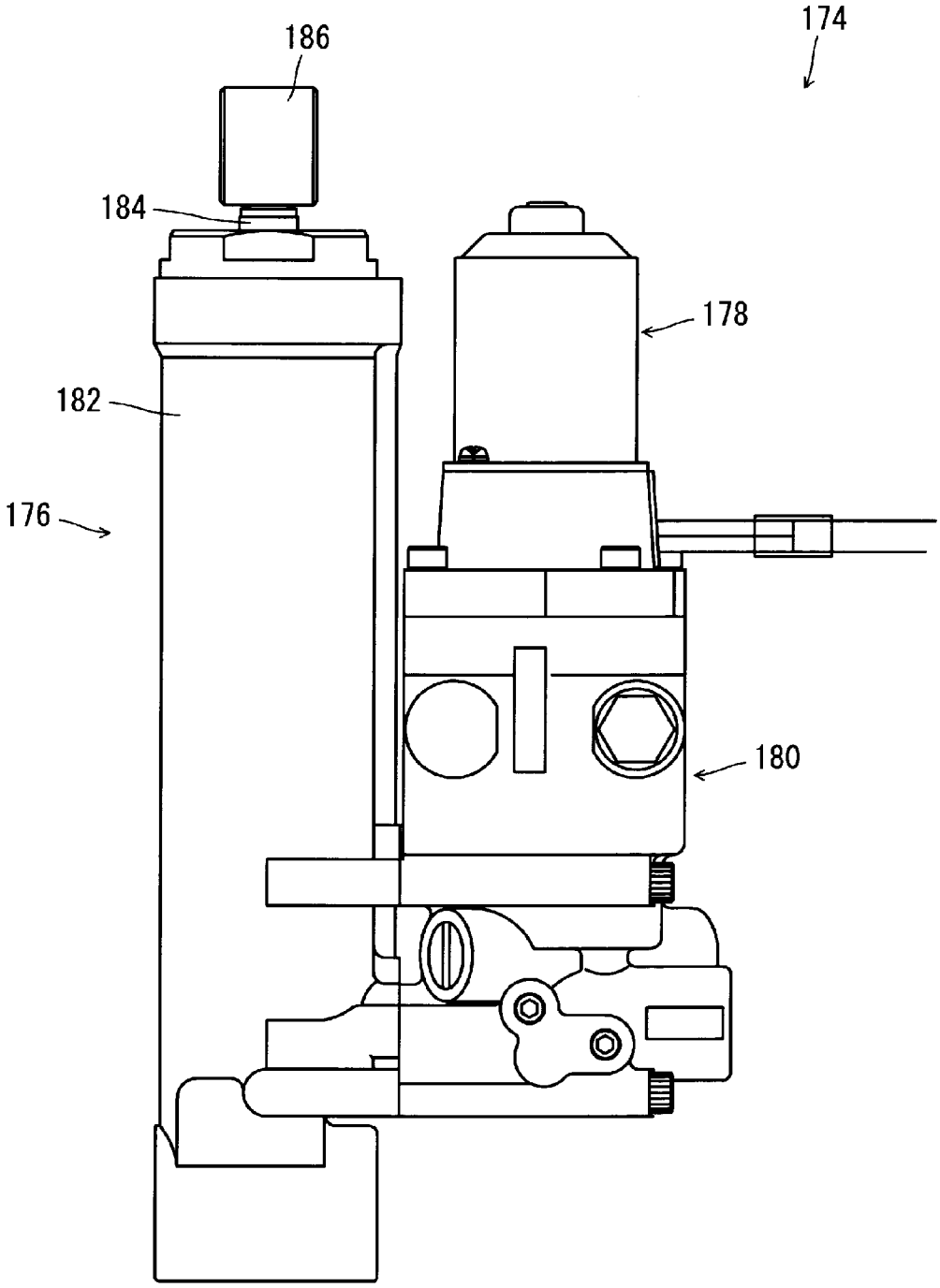
FIG. 19 is a front view showing another example of the power tilt and trim system.

The above-described power tilt and trim system may be replaced by a power tilt and trim system 174 of a construction as shown in FIG. 19.

FIG. 19 show the power tilt and trim system 174, which includes a tilt and trim device 176, a pressure feeder 178 and a reservoir tank 180. In the power tilt and trim system 174, the hydraulic cylinder device according to a preferred embodiment of the present invention is applied to the tilt and trim device 176.

The tilt and trim device 176 includes a tilt and trim cylinder 182 and a piston rod 184. The piston rod 184 has a tip provided with an annular member 186. A connecting shaft 54 (see FIG. 2) of a swivel bracket 38 (see FIG. 2) is rotatably inserted through the annular member 186. The pressure feeder 178 preferably includes, e.g., a hydraulic pump and a motor which drives the hydraulic pump, and sends pressurized hydraulic fluid to the tilt and trim cylinder 182. The reservoir tank 180 stores the hydraulic fluid to be supplied to the tilt and trim cylinder 182.

In the power tilt and trim system 174, the pressure feeder 178 provides adjustment on the hydraulic pressure of the hydraulic fluid inside the tilt and trim cylinder 182, to make an adjustment on the amount of travel (position) of the piston rod 184. When the power tilt and trim system 174 is operated, the swivel bracket 38 (see FIG. 2) makes a pivotal movement in the up-down direction around the tilt shaft 40 (see FIG. 2) as the piston rod 184 moves in and out. This causes the propelling apparatus main body 12 (see FIG. 1) to pivot in the trim range A1 (see FIG. 1) and the tilt range A2 (see FIG. 1). It should be noted here that the power tilt and trim system 174 does not need the trim receiver 50 (see FIG. 2), and therefore it is possible to use a swivel bracket of a simple construction that does not have the recesses 42*a* (see FIG. 2), the projection 48 (see FIG. 2) and the trim receiver 50 (see FIG. 2).

Figure 20:
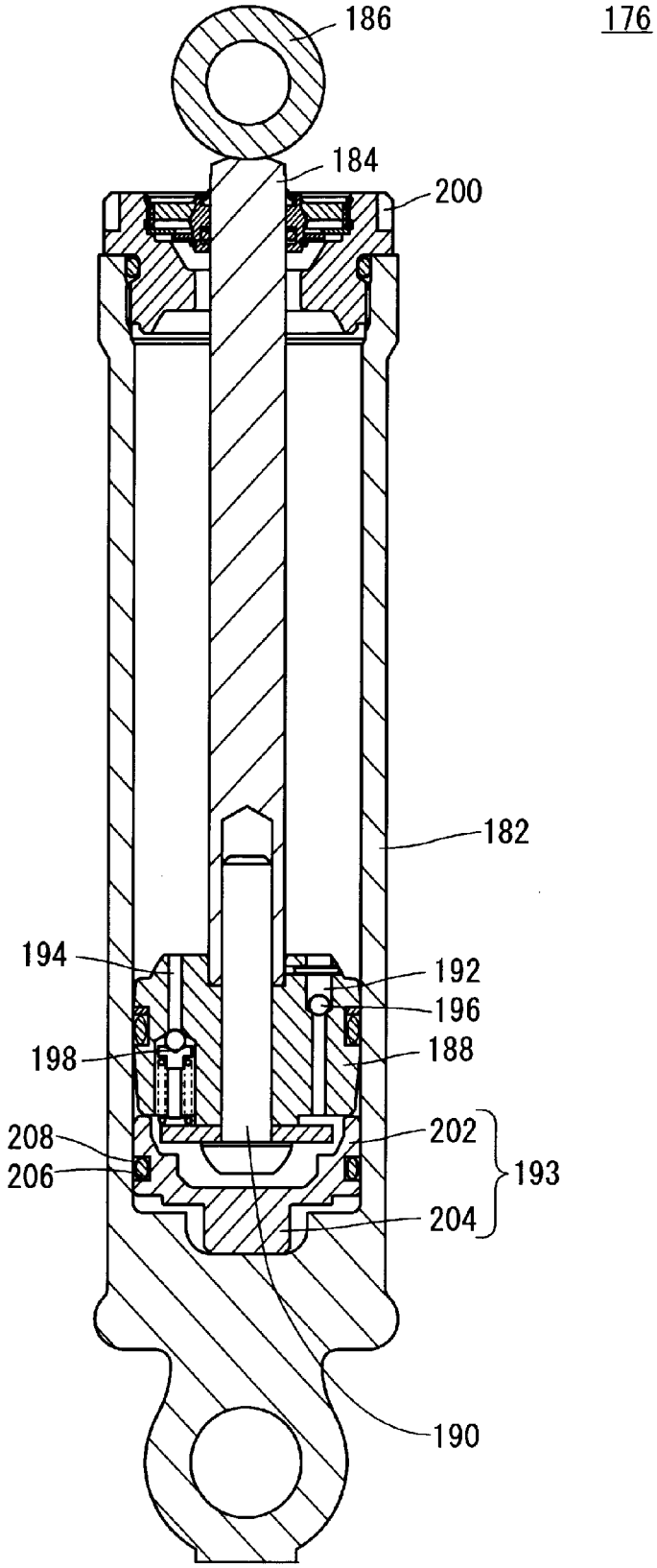
FIG. 20 is a sectional view showing an internal structure of the tilt and trim device.

FIG. 20 is a sectional view which shows an internal construction of the tilt and trim device 176. Referring to FIG. 20, a generally columnar piston 188 is slidably provided inside the generally cylindrical tilt and trim cylinder 182. The piston rod 184 is fixed to the piston 188 with a bolt 190. Inside the tilt and trim cylinder 182, a free piston 193 is slidably provided below the piston 188. The tilt and trim cylinder 182 has an upper end portion and a lower end portion, each having a fluid inlet/outlet port (not illustrated) for hydraulic fluid to move in and out to/from the tilt and trim cylinder 182.

Figure 21:
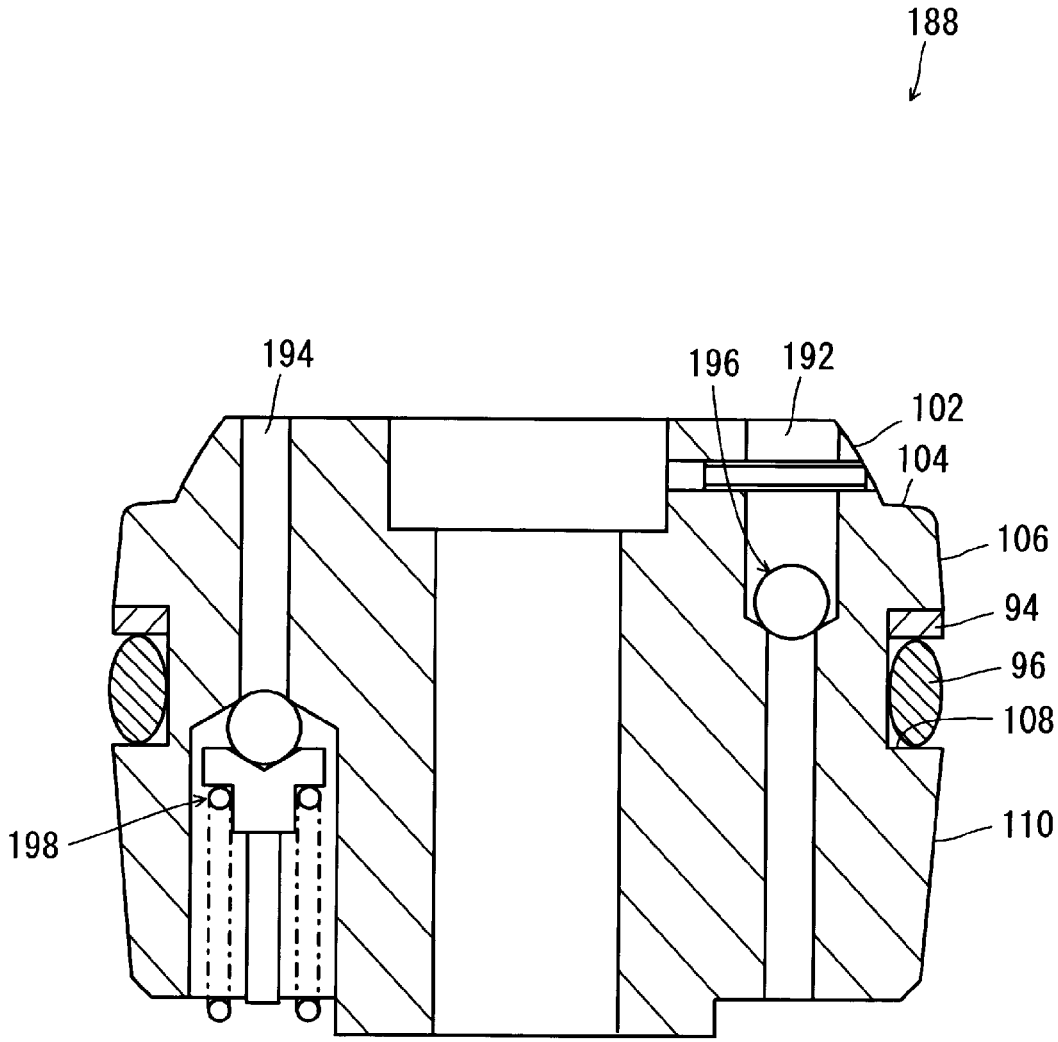
FIG. 21 is an enlarged sectional view of a piston.

Referring to FIG. 21, the piston 188 includes, like the piston 92 in FIG. 8, a partial spherical surface 102, an engagement surface 104, a partial spherical surface 106, and a groove 108. The groove 108 is fitted with a backup ring 94 and an O ring 96. Also, the piston 188 is formed with passages 192, 194 for the hydraulic fluid to flow. The passages 192, 194 are provided with check valves 196, 198 respectively.

Figure 22:
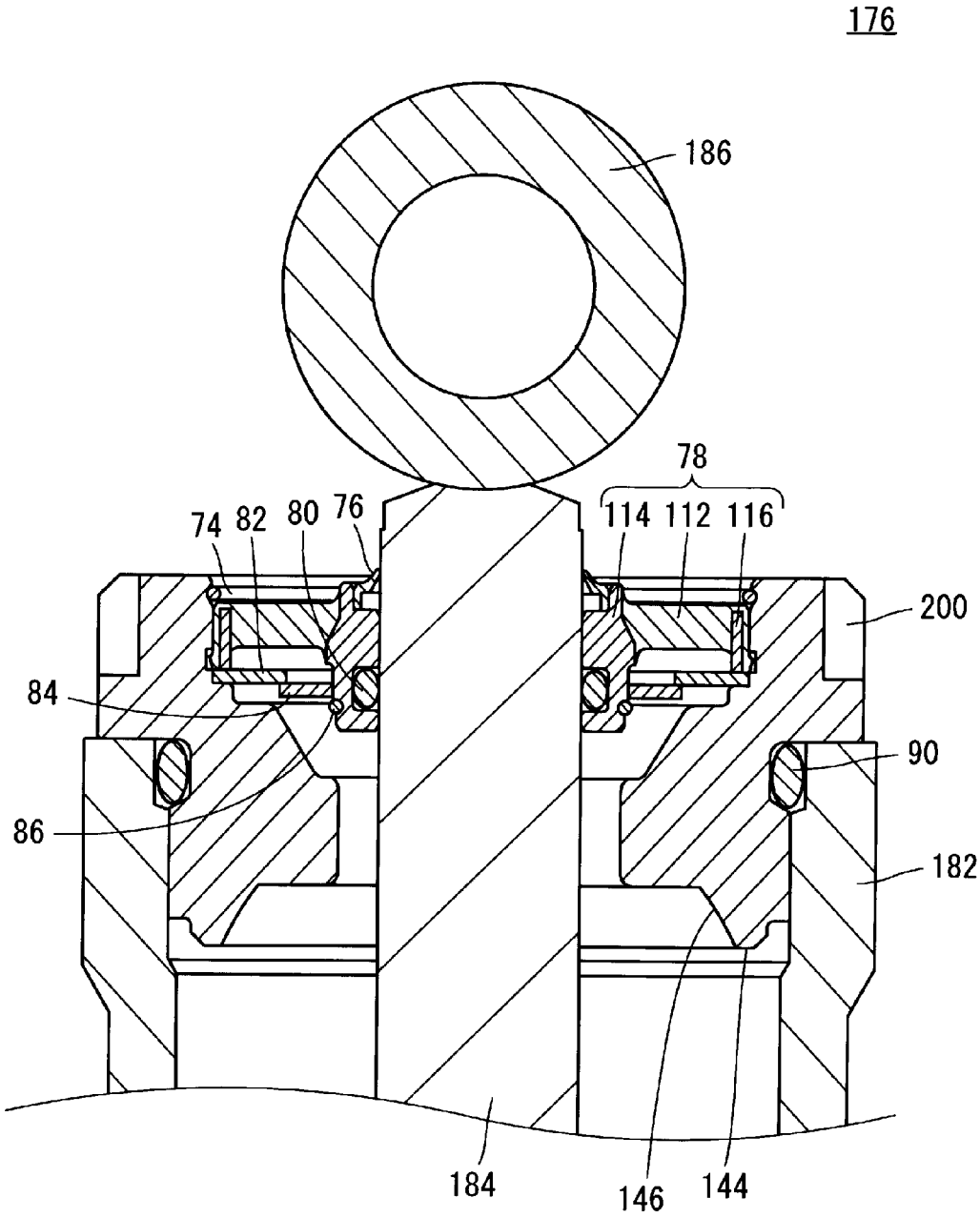
FIG. 22 is an enlarged sectional view showing a tip side (an open-end side of the tilt and trim cylinder) of the tilt and trim device.

Referring to FIG. 22, a cylinder cap 200 is fixed to an upper end of the tilt and trim cylinder 182. The cylinder cap 200 has the same inner circumferential surface as in the cylinder cap 88 shown in FIG. 9. On an upper side of the cylinder cap 200, there are preferably provided a series of components like in FIG. 9, namely, a circlip 74, a dust seal 76, a support member 78, an O ring 80, an outer stopper 82, an inner stopper 84 and a circlip 86. The lower end side of the cylinder cap 200 is, like the cylinder cap 88 in FIG. 9, includes an engagement surface 144 and a partial spherical surface 146. Also, like the trim device 56 in FIG. 9, an O ring 90 is provided between the cylinder cap 200 and the tilt and trim cylinder 182.

Referring to FIG. 20, the free piston 193 includes a cylindrical portion 202 and a columnar portion 204. The cylindrical portion 202 has an outer circumferential surface with a groove 206 formed in a circumferential direction. The groove 206 is fitted with an O ring 208. The cylindrical portion 202 has its upper end surface contacted by a lower end surface of the piston 188.

In the tilt and trim device 176, the tilt and trim cylinder 182 preferably defines the cylinder, the tilt allowance member 112 preferably defines as the elastic member, the circlip 86 or the bulged portion 122 represents the first stopper portion, the outer stopper 82 or the engagement surface 138 represents the second stopper portion, the cylinder cap 200 serves as the limiting portion, the partial spherical surface 146 represents the first curved surface, the partial spherical surface 102 represents the second curved surface, the engagement surface 104 represents the first engagement surface, and the engagement surface 144 represents the second engagement surface.

In the tilt and trim device 176, the free piston 193, the piston 188 and the piston rod 184 rise together when the hydraulic pressure of the hydraulic fluid increases in the lower side of the free piston 193. Also, the piston 188, piston rod 184 and the free piston 193 lower together when the hydraulic pressure of the hydraulic fluid decreases in the upper side of the free piston 193.

Since the tilt and trim device 176 has the same configuration as the trim device 56 described earlier except for the free piston 193, the piston rod 184 and the piston 188 can make the same movement as the piston rod 66 and the piston 92 of the trim device 56. Therefore, the tilt and trim device 176 provides the same advantages as the trim device 56.

In the tilt and trim device 176, when there is a force which acts on the piston rod 184 to cause the piston rod 184 to rise rapidly (when, for example, the propelling apparatus main body 12 (see FIG. 1) is hit by a piece of driftwood), the check valve 198 opens, to allow the hydraulic fluid above the piston 188 to flow via the passage 194 to between the piston 188 and the free piston 193, causing the piston 188 to move from the free piston 193. Thereafter, when there is a force which acts upon the piston rod 184 to lower it (e.g., the weight of the propelling apparatus main body 12), the check valve 196 opens, to allow the hydraulic fluid between the piston 188 and the free piston 193 to flow through the passage 192 to above the piston 188, causing the piston 188 to make contact with the free piston 193 again. As described, according to the tilt and trim device 176, it is possible to adjust the hydraulic pressure of the hydraulic fluid between the piston 188 and the free piston 192 even when there is a force increasing rapidly on the piston rod 184. This makes it possible to sufficiently absorb the impact energy applied to the piston rod 184 and to prevent a large impact force from reaching other constituent members of the tilt and trim device 176.

Also, in the tilt and trim device 176, it is possible to fix the tilt and trim cylinder 182 to the clamp bracket 36 (see FIG. 1). As a note, in a tilt and trim device which is constituted by a single cylinder, the cylinder must be mounted pivotably to a clamp bracket as in the tilt cylinder 68 (see FIG. 2) described earlier. On the other hand, according to the tilt and trim device 176, the piston rod 184 is tiltable against the tilt and trim cylinder 182. Therefore, even if the tilt and trim cylinder 182 is fixed to the clamp bracket 36 (see FIG. 1), the piston rod 184 can make a tilting movement in accordance with the position of the connecting shaft 54 (see FIG. 2). Since it is not necessary to provide a pivotable mounting to the tilt and trim cylinder 182 on the clamp brackets 36, it is now possible to simplify the mounting structure of the tilt and trim cylinder 182.

It should be noted here that in the description made so far above, the present invention was described as preferably being applied to a single-cylinder tilt and trim device. However, the present invention may be applied to a double-cylinder tilt and trim device.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A hydraulic cylinder device comprising:

a cylinder including an open-end side;

a piston provided inside the cylinder and arranged to be slidable in an axial direction of the cylinder;

a piston rod connected with the piston;

a cylinder cap provided in the open-end side of the cylinder; and a support member arranged to be slidable relative to the piston rod to support the piston rod so that an axial center of the piston rod is allowed to be tilted with respect to an axial center of the cylinder; wherein the support member includes an elastic tilt allowance member arranged to urge the piston rod to substantially axially align the piston rod with the cylinder; and a first seal is defined by an outer circumferential surface of the support member being in contact with the cylinder cap on an outer circumferential side of the elastic tilt allowance member, and a second seal is arranged between an inner circumferential surface of the support member and the piston rod on an inner circumferential side of the elastic tilt allowance member, so that the support member and the second seal seal an inner circumferential surface of the cylinder cap and an outer circumferential surface of the piston rod.

2. The hydraulic cylinder device according to claim 1, wherein the support member includes an inner circumferential metal fixed inside the elastic tilt allowance member and slidable relative to the piston rod, and an outer circumferential metal provided on the outer circumferential side of the elastic tilt allowance member; and the inner circumferential metal, the elastic tilt allowance member, and the outer circumferential metal are arranged in substantially axial alignment with each other.

3. The hydraulic cylinder device according to claim 2, further comprising an inner stopper provided in the inner circumferential metal and arranged to be movable in an axial direction of the inner circumferential metal, a first stopper portion provided in the inner circumferential metal and arranged to stop the inner stopper, and a second stopper portion immovable in an axial direction of the cylinder and arranged to stop the inner stopper.

4. The hydraulic cylinder device according to claim 1, further comprising a limiting portion having a first curved surface, wherein the piston has a second curved surface arranged to mate with the first curved surface, a mating contact made by the first curved surface and the second curved surface limits a movement of the piston in an axial direction of the cylinder, and the second curved surface is arranged to slip on the first curved surface for pivotal movement of the piston.

5. The hydraulic cylinder device according to claim 4, wherein the piston includes a first engagement surface facing the limiting portion, and the limiting portion includes a second engagement surface arranged to stop the first engagement surface to limit the piston in its axial center slant angle with respect to the axial center of the cylinder.

6. A boat propelling apparatus comprising:

a swivel bracket pivotable about a shaft in an up-down direction with respect to a boat body;

a propelling apparatus main body mounted on the swivel bracket; and the hydraulic cylinder device according to claim 1 arranged to pivot the swivel bracket in the up-down direction and to perform a slant angle adjustment of the propelling apparatus main body with respect to the boat body.

* * * * *